US006325267B1

(12) United States Patent
Yoshie et al.

(10) Patent No.: US 6,325,267 B1
(45) Date of Patent: Dec. 4, 2001

(54) CLIPPING DEVICE

(75) Inventors: Toru Yoshie; Takuya Satou, both of Tokyo (JP)

(73) Assignee: Max Co., Ltd., Tokyo (JP)

( * ) Notice: Subject to any disclaimer, the term of this patent is extended or adjusted under 35 U.S.C. 154(b) by 122 days.

(21) Appl. No.: 08/980,352

(22) Filed: Nov. 28, 1997

(30) Foreign Application Priority Data

Nov. 27, 1996 (JP) ..... 8-315981
Nov. 29, 1996 (JP) ..... 8-318979
Nov. 29, 1996 (JP) ..... 8-320441

(51) Int. Cl.[7] ..... B21J 15/28
(52) U.S. Cl. ..... 227/2
(58) Field of Search ..... 227/155, 154, 227/3, 4, 2; 29/243.56

(56) References Cited

FOREIGN PATENT DOCUMENTS 47-12089 5/1972 (JP) .

*Primary Examiner*—Peter Vo
*Assistant Examiner*—John Paradiso
(74) *Attorney, Agent, or Firm*—Jacobson Holman, PLLC

(57) ABSTRACT

A clipping device is provided which comprises: a cartridge containing a belt of plate-shaped clips arranged like a belt; a pair of clamps for holding and bending the upper and lower ends of a clip occupying the front of the clip-arranged belt and thereby separating the front clip from the clip-arranged belt and fastening the end of a bundle of sheets with the separated front clip; a slider that reciprocates between the cartridge and the pair of clamps so that the clip-arranged belt is fed from the cartridge to the pair of clamps; a control unit that controls and drives the pair of clamps and the slider; and a clip-setting-detecting unit that detects whether the separated clip is held by the pair of clamps or not. The control unit has a clip-setting-detecting step in which the slider is caused to perform an operation of feeding the clip-arranged belt a predetermined number of times in a state in which the pair of clamps are opened and are ready to receive the clamp-arranged belt and, if the clamp-arranged belt is not detected by the clip-setting-detecting unit during the predetermined number of times, the pair of clamps and the slider are stopped from being driven.

7 Claims, 35 Drawing Sheets

CLIPPING DEVICE

BACKGROUND OF THE INVENTION

This invention relates to a clipping device for fastening a bundle of sheets together with a clip, and more particularly, to a clipping device provided with detecting means for detecting whether the clip has been automatically fed properly or not.

Japanese Utility Model Application Publication No. 47-12089 discloses a clipping device for clasping the end of a plurality of sheets with a clip.

FIG. 42 shows the clipping device disclosed in this publication. In this clipping device, a handle 802 is attached pivotably to an end portion of a base 801. A cover 803 is disposed between the base 801 and the handle 802. A guide channel 804 is formed in the upper surface of the base 801, and a clip-arranged belt 805 is contained between the guide channel 804 and the cover 803. The clip-arranged belt 805 is formed by arranging a plurality of clips 805N like a belt and connecting them by the use of an adhesive agent in the same way as a sheet of staples arranged like a sheet of paper. The clips 805N are each bent into a U-shape.

The other (rear) end of the clip-arranged belt 805 is brought into contact with a metallic fixture 807 which is slidably provided on a push rod 806 shown in FIGS. 43 and 44. The metallic fixture 807 urges the clip-arranged belt 805 by means of a spring 809 wound around the push rod 806. By the urging force, the front end of the clip-arranged belt 805 is brought into contact with the end portion 804A of a guide channel 804.

The push plate 808 is provided on the underside of the handle 802. When the handle 802 is pivoted from the position indicated by the solid line to the position indicated by the phantom line in FIG. 42, the push plate 808 is brought into contact with a base portion of a clip 805N occupying the front of the clip-arranged belt 805, and the clip 805N is separated from the clip-arranged belt 805. Only the separated clip 805N is compressed and deformed by the pressure of the push plate 808. A bundle of sheets of paper are then inserted in the direction of arrow P in FIG. 42, and an end of the bundle of sheets is clasped with the clip 805N.

However, in this conventional clipping device, since a clasping operation is carried out by manually operating the handle 802, it is impossible to mount this device in a business machine, such as a copying machine or FAX machine. Additionally, since the clip 505N is beforehand formed in a U-shape, the clip-arranged belt 805 requires a larger space, and therefore a large number of clips cannot be contained in the clipping device. For this reason, the clipping device must be often replenished with the clip-arranged belt 805.

In a Fax machine placed in, for example, the office of a company, there is a fear that, if several kinds of documents transmitted to the FAX machine are piled up on the tray or desk of the FAX machine, the documents addressed to not one person but many persons will be mixed up promiscuously.

There are some copying machines each having an electric stapler by which copy-papers are stored into a predetermined number of copies. However, in the electric stapler, since the copy-papers are fastened with staples which are driven through the layers of the papers, it is impossible to temporarily and merely classify the copy-papers not to be mixed up.

Therefore, a study is being made of a clipping device which is attachable to a machine for stacking a bundle of sheets, such as a copying machine, a FAX machine, or a business printer, and which is capable of automatically sorting a plurality of copies each of which is a bundle of sheets not to be mixed up.

This type of clipping device has a pair of clamps which are each pivoted on a shaft. The free ends of the clamps face each other so as to hold a clip. The surfaces of the free ends are each provided with a jaw that is engaged with an end of a plate-shaped clip with which a bundle of sheets are fastened. The clip is held by the base of this pair of jaws. The bundle of sheets is placed near the clip, the pair of clamps are then closed, and thereby the clip is bent. Thus, the bundle of sheets is fastened with the clip.

In addition, the clips are each shaped slenderly rectangular, and are connected to the neighboring clips by means of, for example, a film. As a result, the clips are formed into a clip-arranged belt consisting of the clips arranged like a belt. Between a cartridge in which the clip-arranged belt is contained and the pair of clamps, a slider is disposed for feeding the clip-arranged belt from the cartridge to the space between the clamps.

However, in the thus constructed clipping device, there are cases in which, when the slider is moved from the cartridge to the pair of clamps, the pair of clamps are closed in spite of the fact that no clip has fed between the pair of clamps. For this reason, the bundle of sheets, such as copy-papers, will be damaged by the clamps. In addition, there is a fear that the clamps or a mechanism for driving the clamps will be damaged if the clamps are closed in a state in which a plurality of clips are stagnated or a clip is on the way to the clamps.

SUMMARY OF THE INVENTION

It is therefore an object of the present invention to provide an automatically clipping device for holding and bending a clip by the use of a pair of clamps and thereby fastening sheets together with the clip, which is capable of stopping a bending operation of the pair of clamps if the clip is not set between the pair of clamps when an operation of feeding the clip between the pair of clips is performed a predetermined number of times.

The present invention is characterized in that the clipping device comprises: a cartridge containing a belt of plate-shaped clips arranged like a belt; a pair of clamps for holding and bending upper and lower ends of a clip occupying a front row of the belt of plate-shaped clips and thereby separating the front clip from the belt of plate-shaped clips and fastening an end of a bundle of sheets with the separated front clip; a slider that reciprocates between the cartridge and the pair of clamps so that the belt of plate-shaped clips is fed from the cartridge to the pair of clamps; a control means for controlling and driving the pair of clamps and the slider; and a clip-setting-detecting means for detecting whether the separated clip is held by the pair of clamps or not; in which the control means has a detecting step in which the slider is caused to perform an operation of feeding the belt of plate-shaped clips a predetermined number of times in a state in which the pair of clamps are opened and are ready to receive the belt of plate-shaped clips and, if the belt of plate-shaped clips is not detected by the clip-setting-detecting means during the predetermined number of times, the pair of clamps and the slider are stopped from being driven.

DETAILED DESCRIPTION OF THE PREFERRED EMBODIMENTS

First Embodiment

Figure 1:
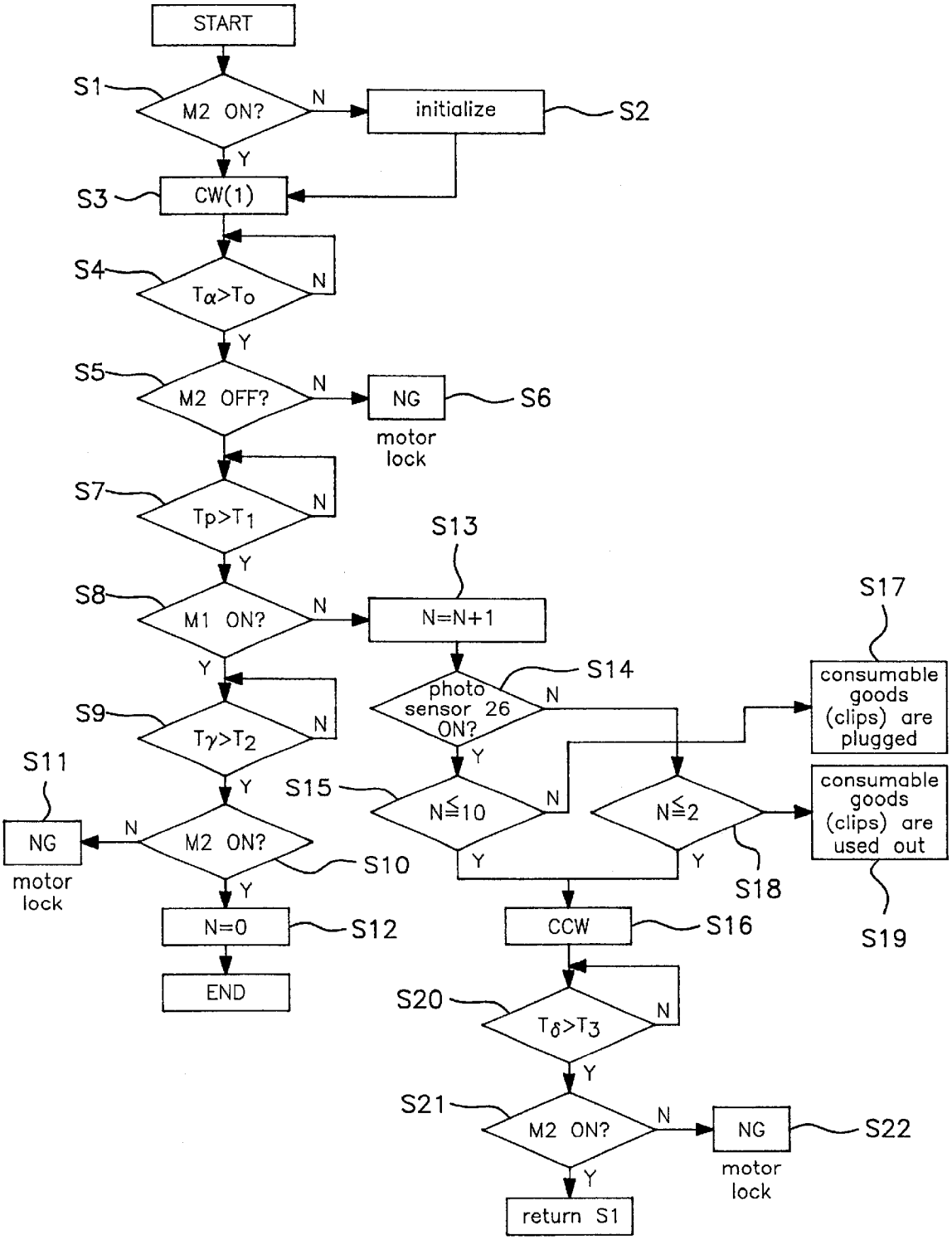
FIG. 1 is a flow diagram showing the control of a feeding operation of a slider by a sequence control unit according to a first embodiment of the present invention.

A clipping device in accordance with the preferred embodiment of the present invention will be explained referring to the drawings.

FIGS. 3 to 17 show generally the construction of a clipping device in this embodiment. In FIGS. 3 to 17, reference numeral 10 designates a clipping device attached to, for example, a copying machine. The clipping device 10 comprises a device body 11 and a cartridge 100 which is attached detachably to the device body 11.

The housing 12 of the clipping device 11 includes a reciprocative moving mechanism 30 for laterally reciprocating a slider 150 attached to the cartridge 100, a clamp mechanism 50 for bending a clip 101, and a driving mechanism 80 for driving the moving mechanism 30 and the clamp mechanism 50.

[Housing]

Figure 3:
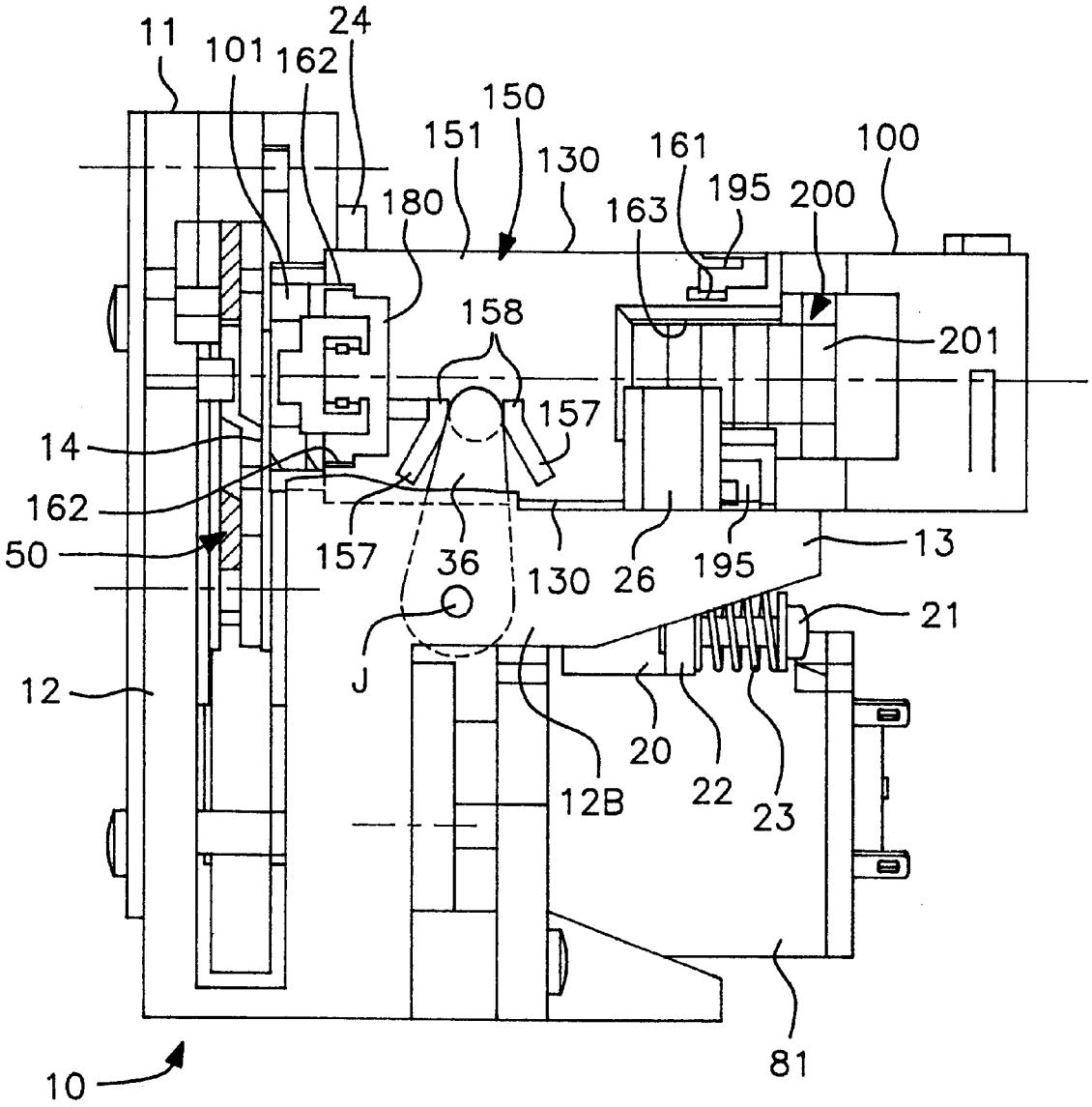
FIG. 3 is a front elevation of a clipping device according to the first embodiment which includes a cartridge and the slider.
Figure 4:
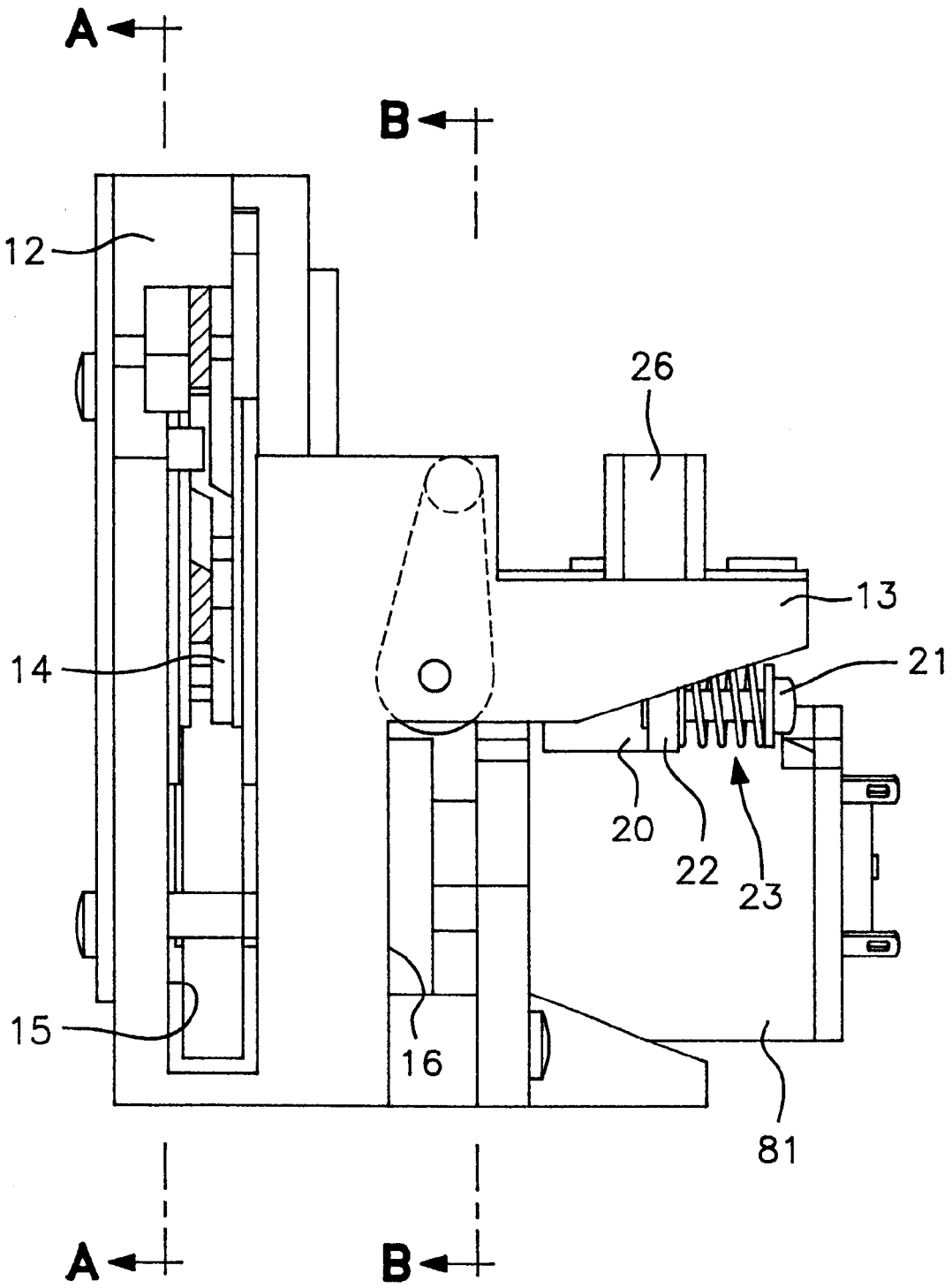
FIG. 4 is a front elevation of the clipping device from which the cartridge is removed, according to the first embodiment.

The housing 12 is, as shown in FIG. 3, provided with a table 13 on which the cartridge 100 is mounted. At the side of the table 13, a clamp chamber 14 is provided which includes the clamp mechanism 50. In the housing 12, a gear chamber 15 and a cam chamber 16 (see FIG. 14) are further provided under the table 13 and the clamp chamber 14.

The table 13 is provided with a rectangular arm opening 17 which extends laterally (in FIG. 5), an unlocking opening 18 which extends laterally and has two different widths, and an engaging opening 19 which extends vertically and has a larger width in the middle thereof.

On the side surface of the unlocking opening 18, a projection 18A is formed. The projection 18A has a slope formed to project from the opening 18 longer as it extends downward.

On the under surface of the table 13, as shown in FIG. 3, a holding portion 20 is formed. A screw 21 is inserted in the holding portion 20. An engaging piece 22 is attached to the screw 21 so as to be moved along the screw 21. The engaging piece 22 is urged in the right direction (in FIGS. 3, 4 and 6) by means of a spring 23 attached to the screw 21.

Figure 5:
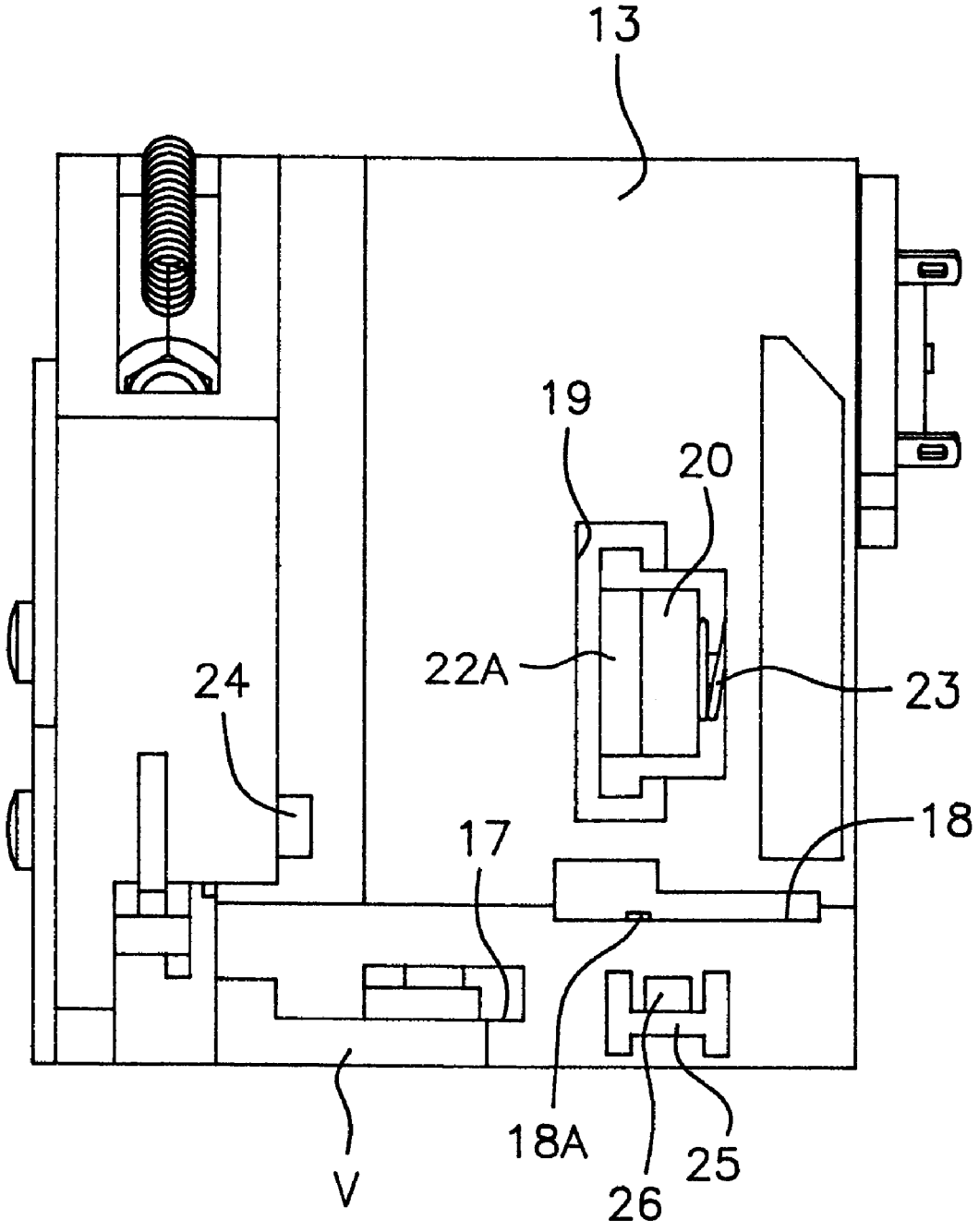
FIG. 5 is a plan view of the clipping device of FIG. 4.
Figure 15:
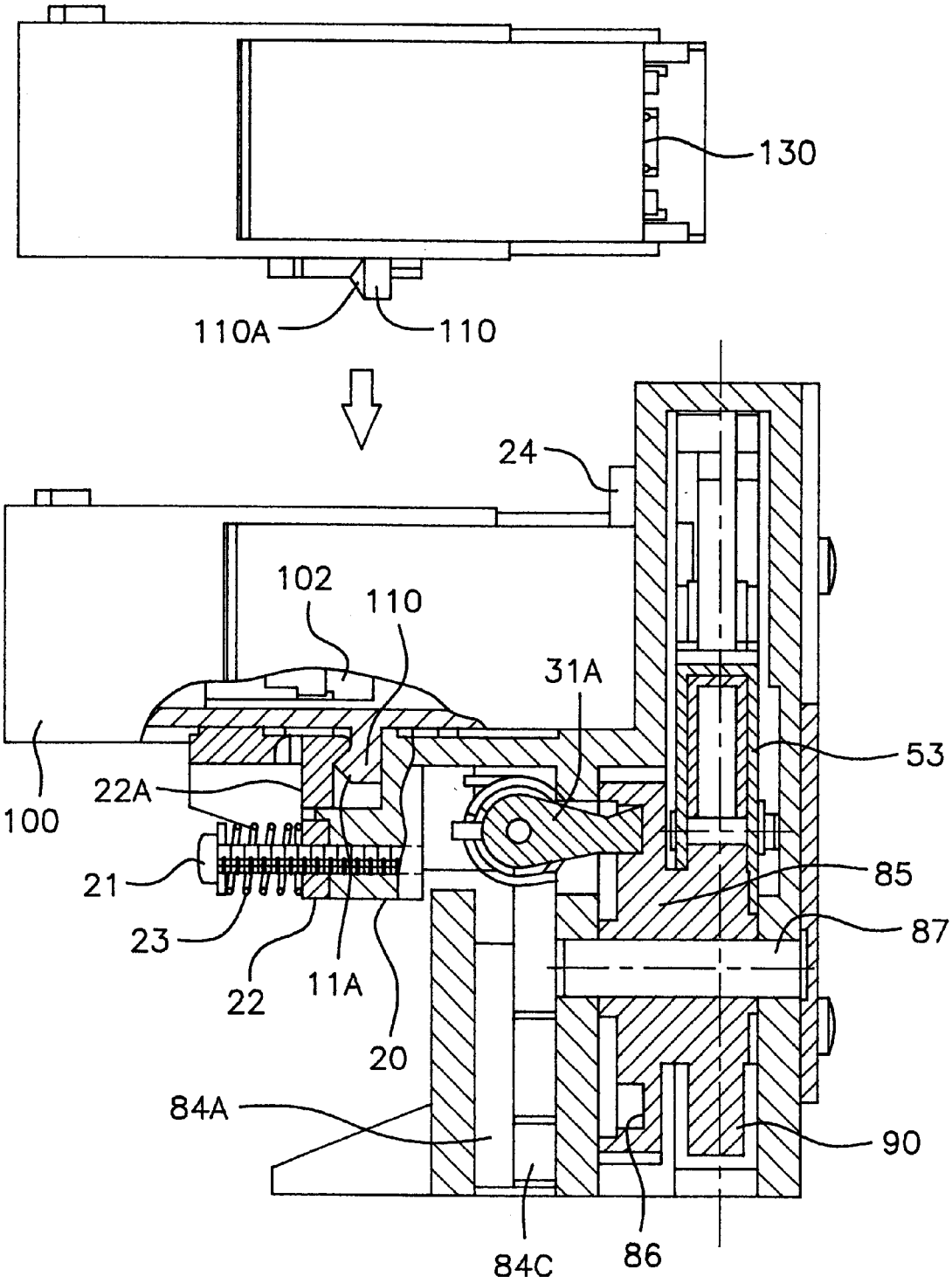
FIG. 15 is a sectional view, seen from the rear side, showing the clipping device and the cartridge to be mounted in the clipping device.

On the top side of the engaging piece 22, an engaging portion 22A is formed projecting leftward in FIG. 5 (rightward in FIG. 15). The engaging portion 22A is inserted in the engaging opening 19. A predetermined gap is formed laterally between the engaging portion 22A and the engaging opening 19 (in FIGS. 3, 4 and 6). The engaging portion 22A and an engaging projection 110A are engaged, and thereby the cartridge 100 is fixed to the top surface of the table 13.

Over the table 13A, a guide rail 24 is formed which vertically extends along the side wall 14A defining the clamp chamber 14. At the front side of the top surface of the table 13, a supporting member 25 is provided projecting upward from the top surface of the table 13. The supporting member 25 is provided with a sensor 26 (i.e., detecting means for detecting whether clips exist in place) comprising a light emitting diode 26A and a light receiving diode 26B.

The sensor 26 detects the existence of a clip in such a way that the light emitted from the light emitting diode 26A is reflected by a film 201 of the clip-arranged belt 200 located on a carrying path of the cartridge 100 (described later in detail), and then the reflected light is received by the light receiving diode 26B for detecting whether the clip 101 exists or not. Since the detection is performed based on the reflected light from the film 201, a detection result is strictly accurate. If the detection is performed based on the reflected light from the clip 101, the clip 101 cannot be detected when the sensor 26 is situated in the gap between the clips 101 and 101.

Figure 11:
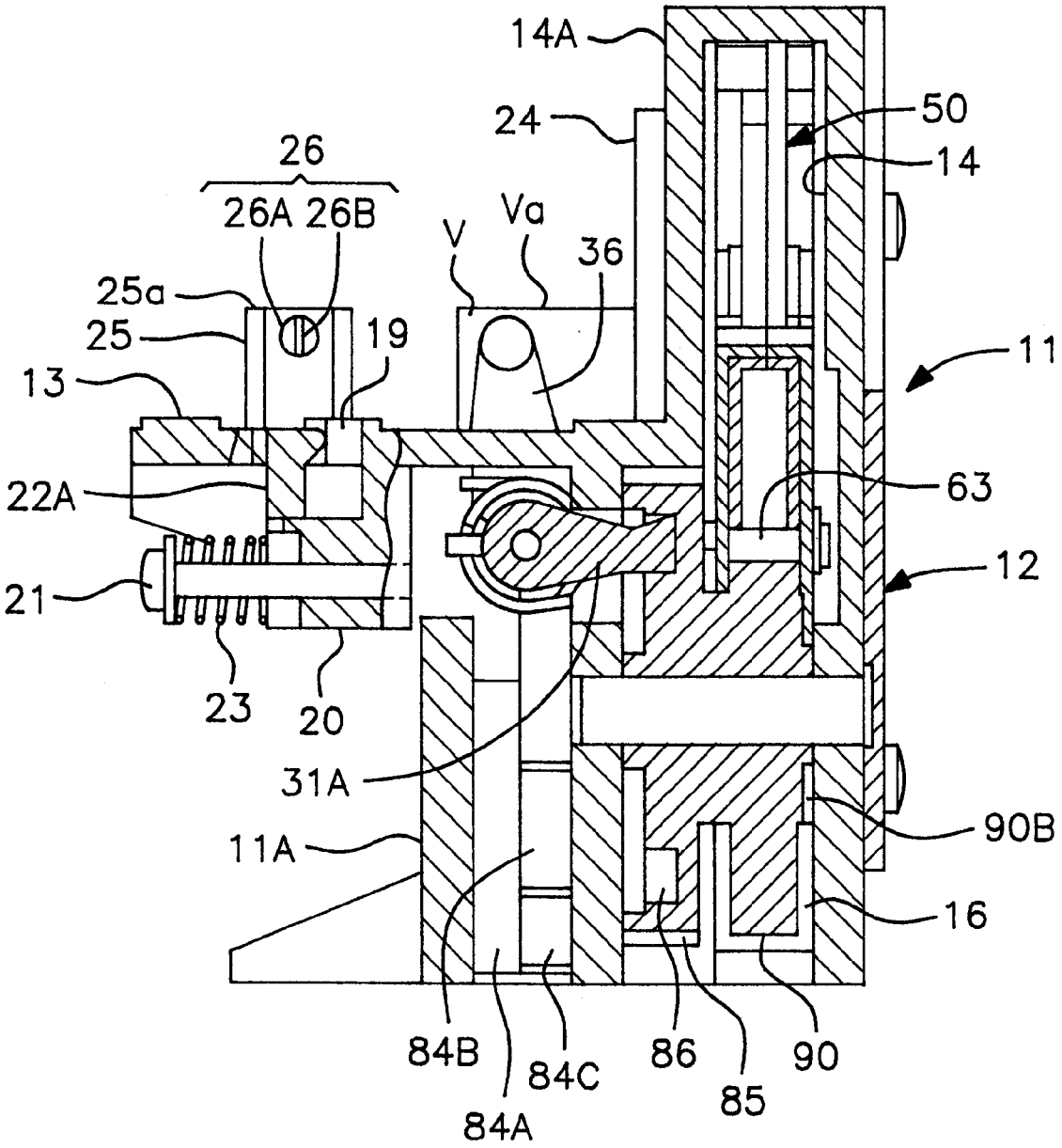
FIG. 11 is a sectional view, seen from the rear side, showing the clipping device from which the cartridge is removed, according to the embodiment of the present invention.

At the front end portion of the table 13, a front wall portion V is formed. At the front end portion of the side wall 28 in the housing 12, a step portion 28A is formed on which a bundle of sheets S is mounted (see FIG. 7). As shown in FIG. 11, the top surface Va, the step portion 28A, and the top surface 25*a* of the supporting portion 25 are the same in level, in order to place the bundle of sheets S thereon.

Inside of the side wall 28, there are disposed a stopper 29 for stopping the clip 101 fed by the slider 150 at a predetermined position, and a micro switch M1 which detects that the clip 101 has reached the predetermined position. Reference symbol M2 in FIG. 7 designates a micro switch which detects whether of not the clamp portions 51, 52 are opened as result of the return of a driving cam 85 (described later) to an initial position (home position). The micro switch M2 detects a concave portion 90A formed in the disk-shaped convex portion 90B projecting from the side surface of the cam 90 shown in FIG. 8(A), based on the direct contact with the concave portion 90A, for example, and thereby detects that the driving cam 85 has reached the initial position (home position).

Figure 8A:
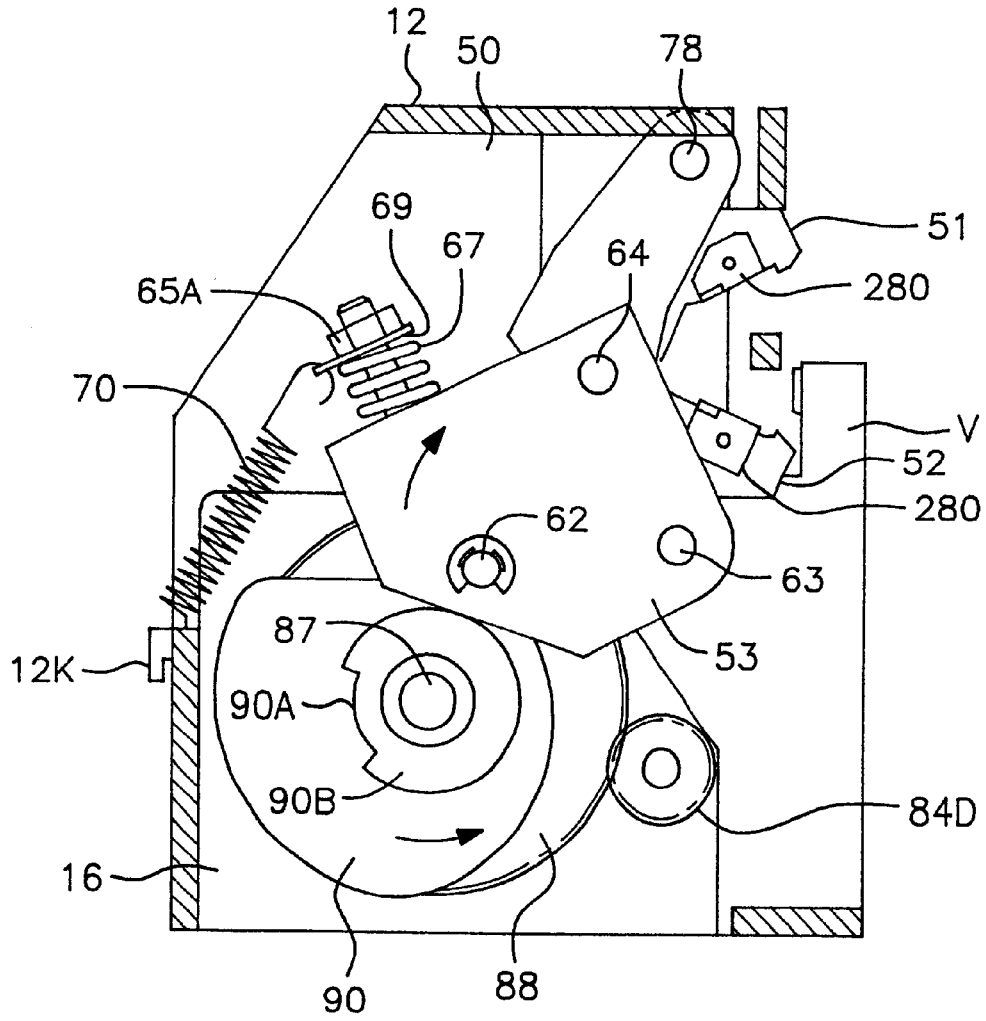
FIG. 8(A) is a sectional view showing the inside of the clipping device according to the first embodiment, seen from the left side.
Figure 8B:
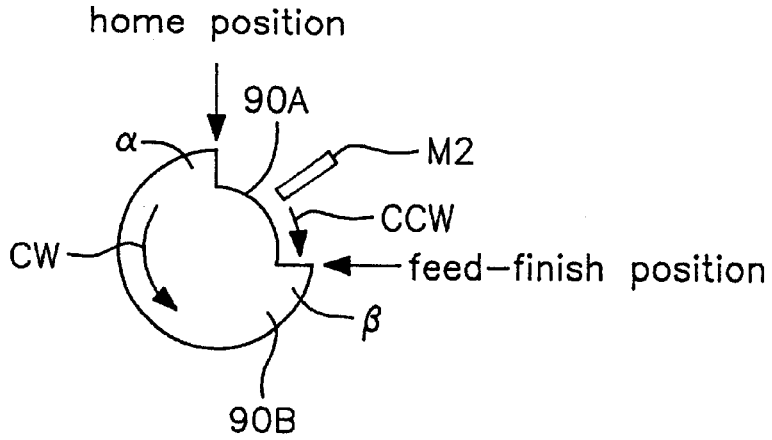
FIG. 8(B) shows the positional relationship among the disk-shaped convex portion and concave portion of a cam, a micro switch M2, a home position, and a feeding-finish position.
Figure 9:
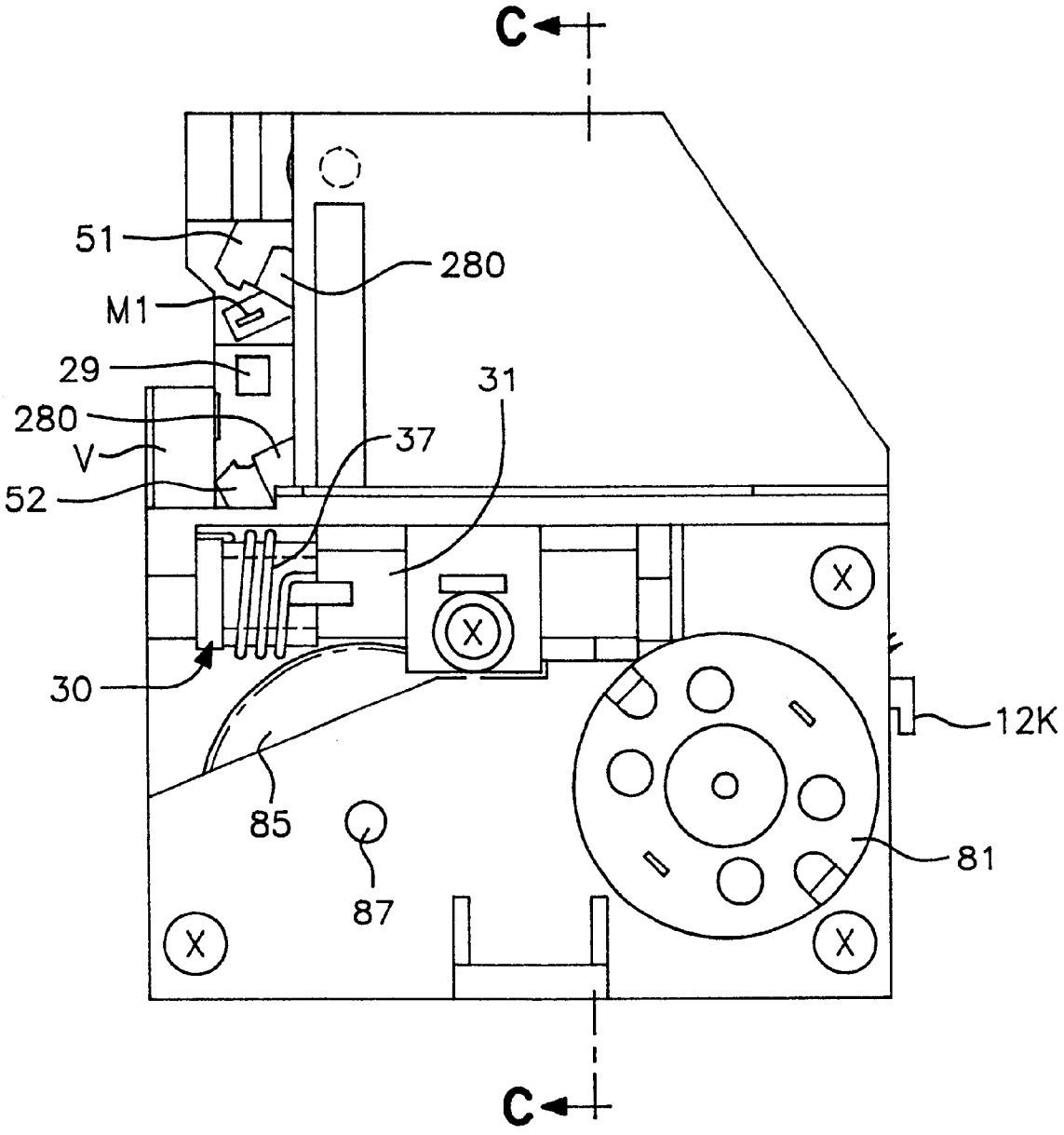
FIG. 9 is a sectional view, seen from the right side, showing the clipping device from which the cartridge is removed, according to the embodiment of the present invention.
Figure 10:
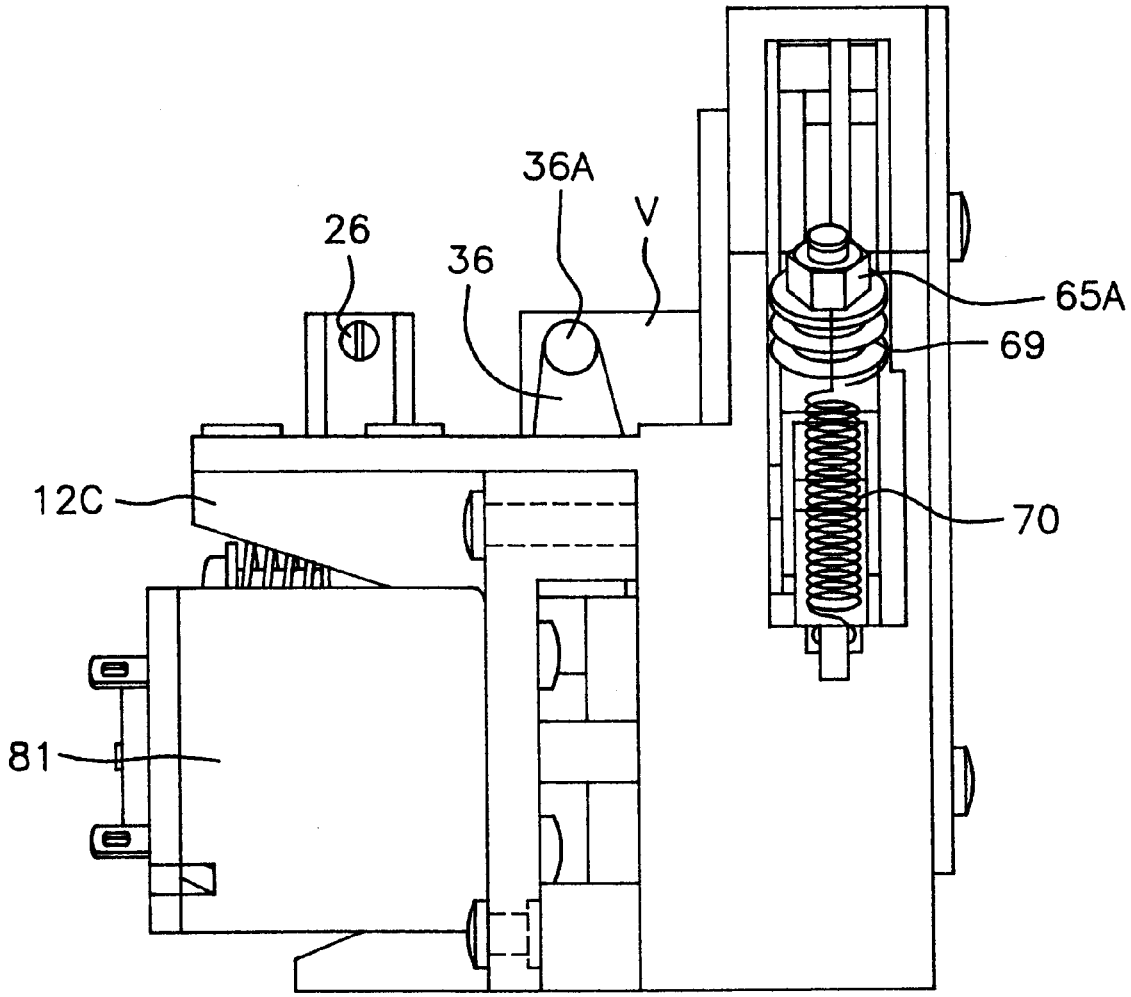
FIG. 10 is a rear elevation showing the clipping device from which the cartridge is removed, according to the embodiment of the present invention.

FIG. 8(B) shows the positional relationship between the micro switch M2 and the concave portion 90A. An edge α of the concave portion 90A of the cam 90 which is on the front side in a rotational direction corresponds to a home position where the micro switch M2 is turned on. On the other hand, and edge β of the concave portion 90A which is on the rear side in the rotational direction corresponds to a clip-feeding-finish position where the micro switch M2 is turned off.

Reverse rotation is allowed in a range from the point where the edge α of the concave portion 90A meets the micro switch M2 to the point where the edge β of the concave portion 90A passes over the micro switch M2. If the edge β of the concave portion 90A of the cam 90 has passed over the micro switch M2, the position of the edge β becomes the feeding-finish position at which the clip 101 is set in the clamp portions 51, 52. The feeding-finish position is in a range where reverse rotation is unallowable.

In order to eliminate over run of a clamp operation by decreasing the inertia caused by the rotation of a motor, the following electric control is carried out. In normal rotation, a motor 81 is driven at a voltage of 12 V from the home position to the feeding-finish position for the clip 101 (from the edge α to the edge β of concave portion 90A), and the motor 81 is driven at a voltage of 24 V after the feeding-finish position β. On the other hand, in reverse motor rotation, the motor 81 is driven at a voltage of 6 V for the passing of the concave portion 90A. Thus, the clamp operation is controlled against the increase of inertia.

[Driving mechanism]

The driving mechanism 80 comprises the driving motor 81 (See FIG. 3 and FIG. 4), which is attached to the side wall 12A of the housing 12; a gear 83, which is provided on the driving shaft 82 of this driving motor 81 (See FIG. 12); a reduction gear train 84, which is applied so as to be mated with this gear 83 and which has reduction gears 84A to 84D; and the driving cam 85, which has gear teeth applied so as to be mated with the reduction gear train 84. The gears 83, 84A to 84D are placed in the gear chamber 15 of the housing 12. The driving cam 85 is placed in the cam chamber 16.

Figure 12:
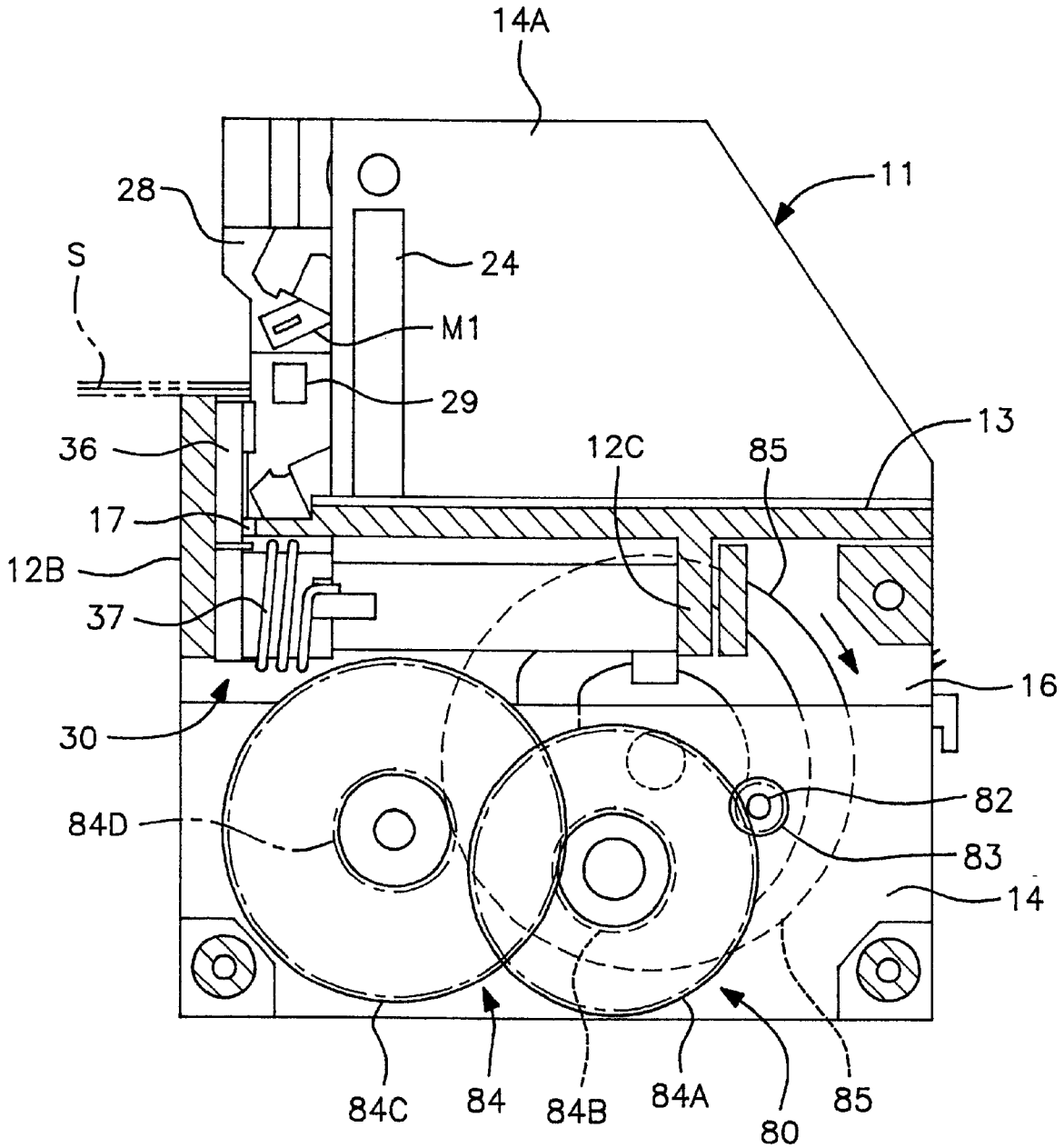
FIG. 12 is a sectional view, seen from the right side, showing the clipping device from which the cartridge is removed, according to the embodiment of the present invention.

The driving cam 85 is rotated in the direction of arrow shown in FIG. 12, through the means of gears 83, 84A to 84D, by the driving motor 81.

Figure 13:
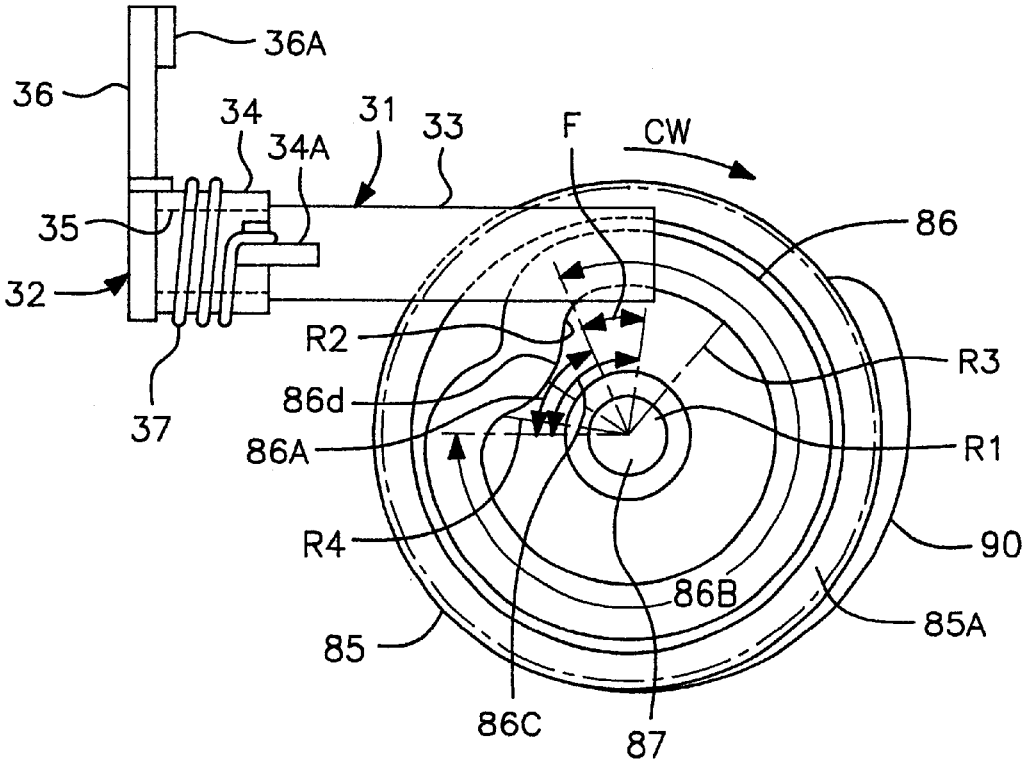
FIG. 13 is a partially enlarged view showing the engagement relationship between a cam and an arm portion for moving the slider, according to the embodiment of the present invention.
Figure 14:
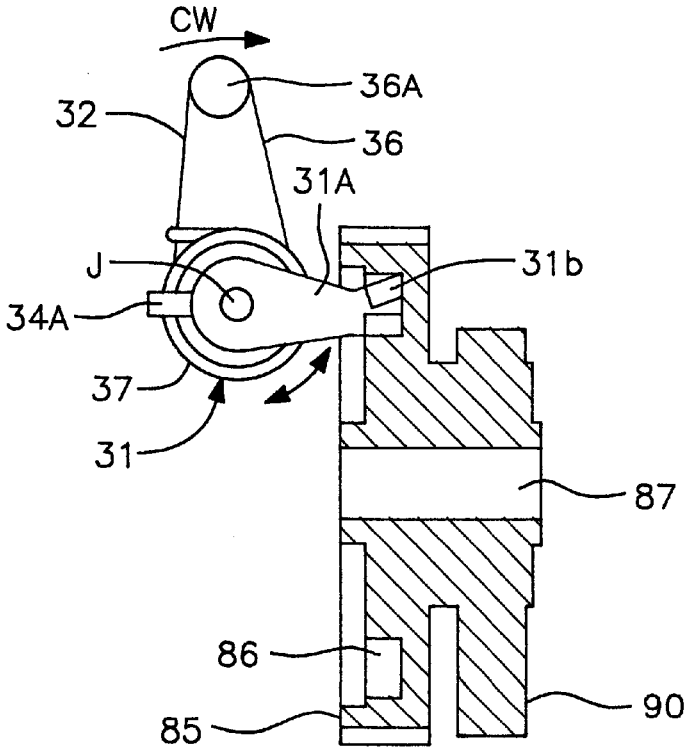
FIG. 14 is a partially enlarged view showing the engagement of the arm portion with a channel of the cam FIG. 13.

On the one side surface 85A of the driving cam 85, as shown in FIG. 13, an annular cam channel 86 is formed. The cam channel 86 has a smaller diameter portion 86A, which has decreasing distance between the center of rotary shaft 87 and the circumference of this portion 86A, and a larger diameter portion 86B, which has the same distance between the center and the circumference of this portion 86B.

The driving cam 85 is provided integrally with the cam 90, which is rotated together with the driving cam 85.

As shown in FIG. 13, in the cam 90, a small diameter portion R1, whose diameter is minimum; an increasing diameter portion R2, whose diameter is increased; a larger diameter portion R3, whose diameter is maximum; and a decreasing diameter portion R3, whose diameter is decreased, are provided. Then, the smaller diameter portion R1 corresponds to a portion 86C, which includes the home position α and smaller diameter portion 86A (See FIG. 13).

[moving mechanism]

A moving mechanism 30 comprises, as shown in FIGS. 11 to 13, the first link member 31 and second link member 32, which are attached pivotably to the shaft J (See FIG. 14) and the supporting portion 12B, 12C of the housing 12.

The first link member 31 comprises a shaft portion 33, which has an arm portion 31A having the fore end portion 31*b* inserted into the cam channel 86, and a cylinder portion 34, which is formed so as to be continuous to the one end of this shaft portion 33. Then, the rotation of driving cam 85 allows the vertical movement of fore end portion 31*b* of the arm portion 31A through the means of cam channel 86, whereby the first link member 31 can be pivoted around the shaft J in the direction of arrow shown in FIG. 14.

The second link member 32, as shown in FIG. 13, comprises a shaft portion 35, which is engaged pivotably in the cylinder portion 34; and an arm portion 36, which is extended upward from the shaft portion 35. An engaging projection 36A is formed at the top of arm portion 36. A coil spring 37 is provided so as to be wound around the external surface of cylinder portion 34 of the first link member 31. The one end of coil spring 37 is engaged and fixed to an engaging portion 34A formed on the first link member 31, while the other end of coil spring 37 is engaged and fixed to the arm portion 36 of second link member 32. Due to this coil spring 37, the second link member 32 can be pivoted together with the first link member 31. When the pivot of first link member 31 is stopped, only the first link member 31 turns to pivot relatively with the second link member 32.

Figure 6:
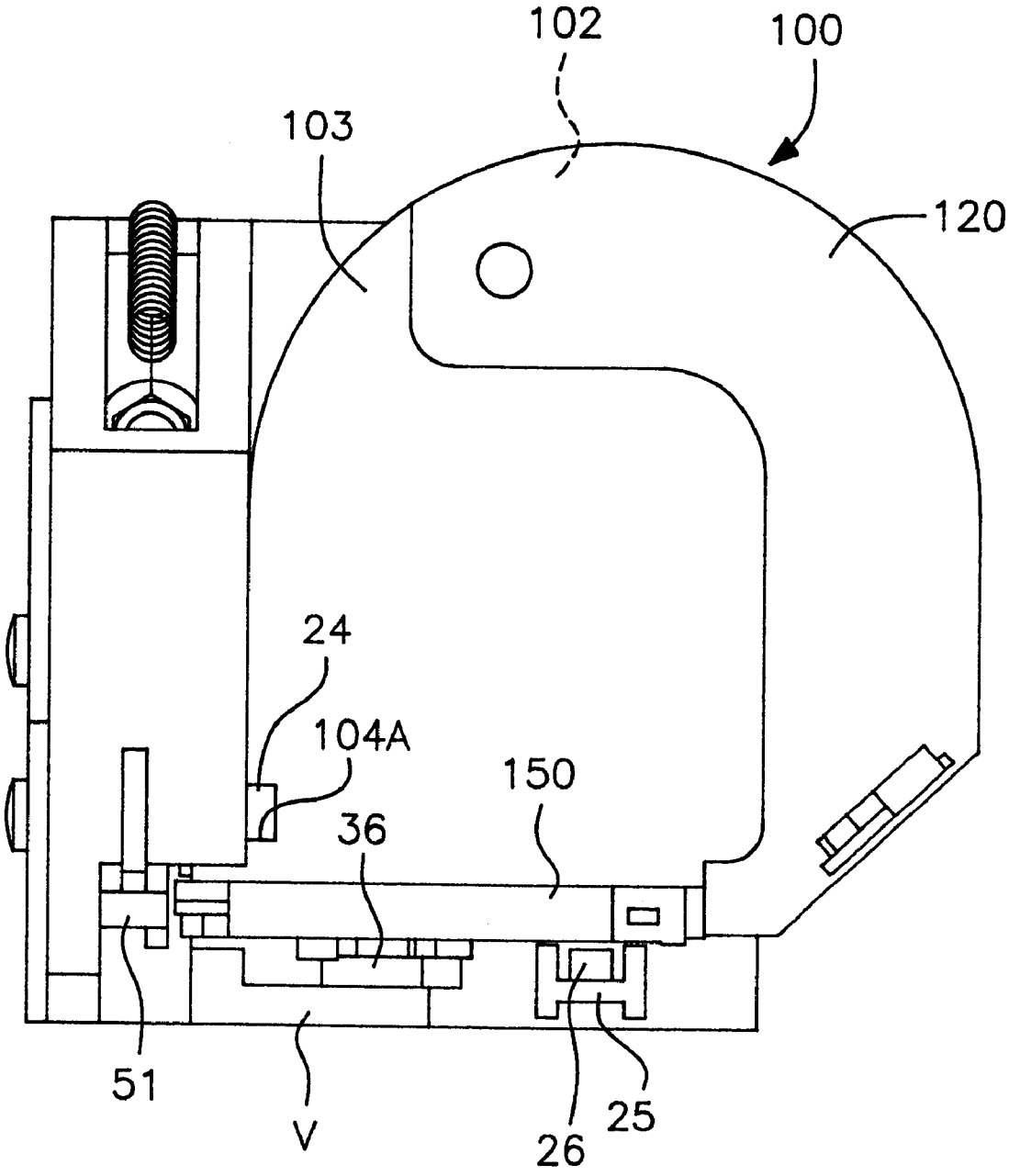
FIG. 6 is a plan view of the clipping device of FIG. 3.
Figure 7:
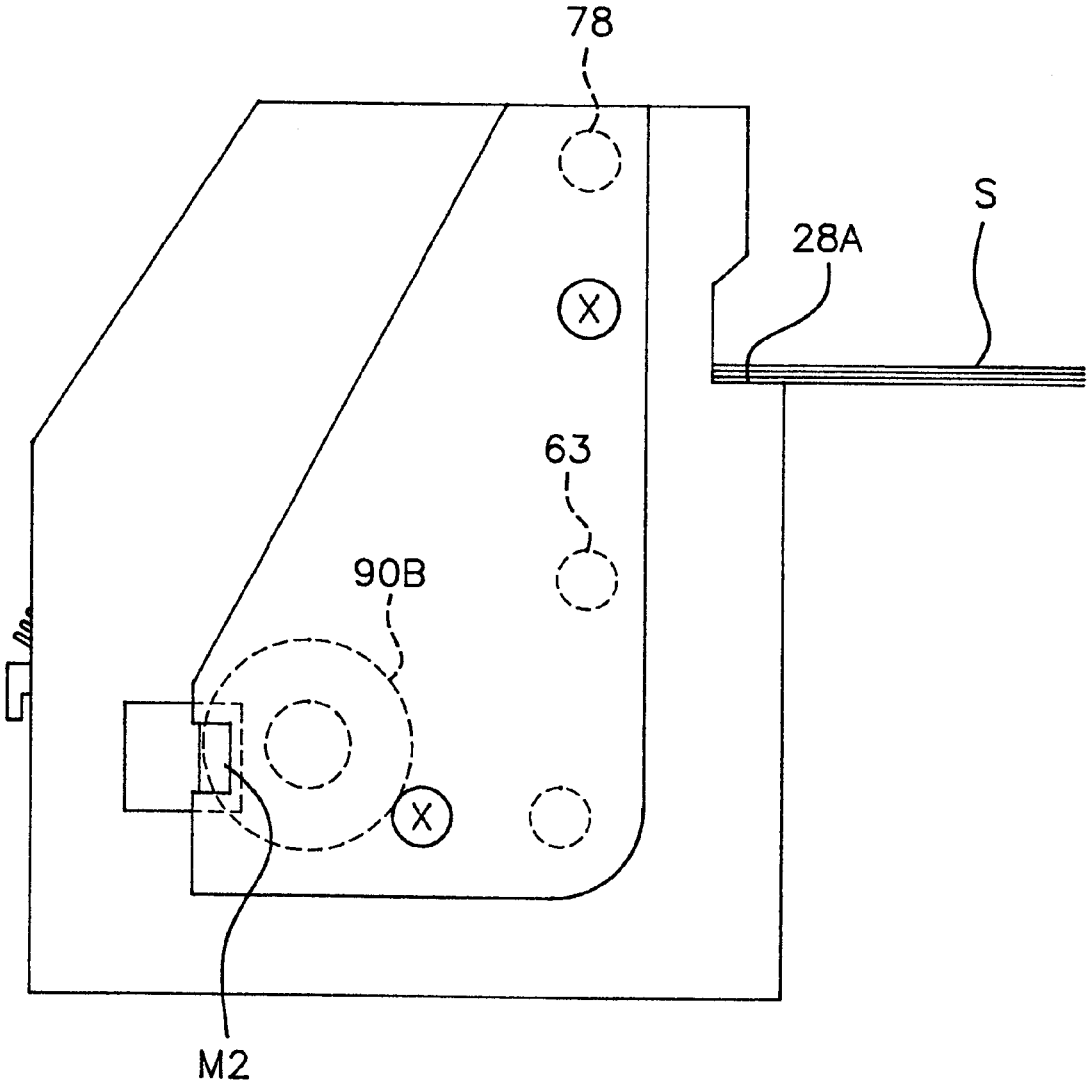
FIG. 7 is a left side elevation of the clipping device of FIG. 4.

Accompanied with the pivot of the second link member 32, the arm portion 36 pivots so that the slider 150 can be reciprocated in the transverse direction in FIGS. 3 and 6.

[Clamp mechanism]

A clamp mechanism 50 comprises, as shown in FIG. 8(A), a pair of clamp members 51, 52; two clamp pivot members 53, between both of which these clamp members 51, 52 are placed; and a shaft 62, which is attached to the clamp pivot members 53 and which is brought into contact with the circumferential surface of the driving cam 90.

[Clamp pivot member]

The clamp pivot members 53 comprises a pair of side plate portions, which are opposed each other; and a connecting plate portion, which is formed by connecting the upper flanges of the side plate portions. The shaft 63 is inserted through each side plate. This shaft 63 is attached to the side wall defining the clamp chamber 14 of the housing 12. Each clamp pivot member 53 can be pivoted around the shaft 63 serving as the supporting point. Further, a shaft 62, which serves as a cam follower of cam 90, is attached pivotably to the pair of side plate portions of the clamp pivot members 53.

A nut 65A is applied so as to be mated with the pair of side plates at their top, through the means of spring 67. Then, by the spring 67, the connecting plate portions of clamp pivot members 53 are urged in the direction so that the connecting plate portions are closed each other and that the pair of side plate portions are pivoted integrally around the shaft serving as the supporting point. The reference number 69 designates a washer, which is placed between the spring 67 and nut 65A. The one end of spring 70 is engaged and stopped at the washer 69. The other end of spring 70 is engaged and stopped at the engaging stopper 12K of the housing 12.

The pair of side plates of clamp pivot members 53 can be pivoted relatively each other with the predetermined amount against the spring force of spring 67 around the shaft 63 serving as the supporting point. Accordingly, with regardless to the thickness of bundle of sheets S, the cam 90 can be pivoted smoothly.

The spring 70 urges the clamp pivot member 53 in the counter clockwise direction in FIG. 8 around the shaft 63 serving as the supporting point. Due to this urging, the shaft 62 attached to the clamp pivot members 53 is always brought into contact with the circumferential surface of the driving cam 90, whereby the clamp members 51, 52 are always urged so as to be opened.

[Clamp member]

The clamp members (portions) 51, 52, each of which is an arm of L-shaped plane plate, are pivoted around the shaft 78 and shaft 63, respectively. At the fore end portions of clamp members 51, 52, push-members 280, 280, each of which has the U-shaped cross section, are provided, respectively. When the clamp members 51, 52 are pivoted around the shafts 63, 78 serving as supporting points, respectively, the clamp members 51, 52 are closed each other, whereby the clip 101 becomes to be bent. Then, the bending portion of bent clip 101 is locked inwardly by the push-members 280, 280 of clamp members 51, 52.

The driving motor 81 is controlled by a control circuit (not shown), which controls the driving motor 81 on the basis of, for example, nipping signal output from the copying machine body, detecting signal output from the sensor 26 and the like.

[Cartridge]

As shown in FIG. 6, the cartridge 100 comprises a cartridge body 103, which defines a substantially circular-shaped storage chamber 102; and a cover body 120, which is provided so as to be opened and closed on the cartridge body 103. The cartridge body 103 is configured so that a clip-arranged belt, which is wound so as to be a role and which is stated below, can be contained easily in the storage chamber 102. At the end portions of bottom plate and top plate of cartridge body 103, there are concave portions 104A, into which the guide rail 24 of the device body 11 is engaged. At the under surface of the bottom plate, an engaging piece 110 having a projection 110A is provided so that the engaging piece 110 is inserted into an engaging port 19 formed on the table 13 of the device body 11. By inserting of engaging piece 110 into the engaging port 19, the projection 110A of the engaging piece 11 engages to the engaging portion 22A of the engaging piece 22 in the device body 11 so that the cartridge 100 is attached to the table 13.

Further, at the under surface of the bottom plate, there is a locking member, which is inserted into the unlocking port 18 of the table 13 so as to unlock the slider 150. Precisely, on securing the cartridge 100 to the table 13 of the device body 11, the locking member is inserted into and engaged to the unlocking port 18, then, the engaging piece, which is formed at the edge of lower portion of the slider 150, is removed. Finally, the slider 150 is unlocked.

At the front side of cartridge body 103, there is a plate-shaped guide plate portion 130, which supports the slider 150 at its edge from its top and bottom sides and guides the slider 150, at the same time, which carries the clips 101. The slider 150 is attached so as to move in the transverse direction to the guide plate portion 130. Above and below the guide plate portion 130, guide portions, which guide the upper and lower sides of each clip 101, are formed. Then, in the lower and upper portions of guide portion, there are linear projections extending transversely for guiding the slider 150 transversely. At the medium portions of guide plate portion 130, a pair of projecting bar portions are formed so as to extend in the transverse direction for guiding the clips 101.

The guide plate portion 130 is provided with four square holes at its front and rear sides in the feeding direction of clip 101. From each square hole, the fore end portion of non-return claw is projected so as to engage to the clip 101, but can be pulled back due to its elasticity. These non-return claws allow the slider 150 to feed the clips 101 to the clamp portions 51, 52. On the other hand, when the slider 150 is moved so as to apart from the clamp portions 51, 52, these non-return claws prevented the clips 101 from returning back.

[Slider]

As shown in FIG. 3, the slider 150 comprises a rectangular-shaped plate member 151; holding portions, which are provided above and below the rectangular-shaped plate member 151 and which have grooves engaging the guide plate portion 130; engaging pieces, which are provided below the holding portions; a pair of projecting bar portions, which are extending in the transverse direction inside the plate member 151; and trapezoid shaped guide portions 157, 157 with engaging portions 158, 158, which are provided outside the plate member 151 and which guide the engaging projection 36A of the arm portion 36 in the second link member 32.

Between these engaging portions 158, 158, the engaging projection 36A of the second link member 32 is inserted. The pivotation of arm 36 of the second link member 32 around the shaft J allows the slider 150 to reciprocate.

At the front and back sides of the plate member 151, square holes are formed on its upper and lower portions. At the front side, notches each having the slit-shape are formed on the top and bottom surfaces. At the back side, an rectangular-shaped notch 163 is formed so that the film 201 of the clip-arranged belt 200 can be detected by means of sensor 26.

Further, a front feeding claw plate 180 is attached to the plate member 151 and the front feeding claws of front feeding claw plate 180 are inserted into notches 162, 162, respectively. The front feeding claw is projected out toward the cartridge 100-side of the plate member 151 so as to engage to the clip 101. This engaging enables the clip 101 to feed to the fore end-side.

In the same way, rear feeding claw plates 195, 195 are attached to the rear portion of the plate member 151 and the rear feeding claws of rear feeding claw plates 195, 195 are inserted into the square holes provided upper and lower rear portions. Then the fore end portions of rear feeding claws engage to the clip 101 in the same way as stated above. These four front and rear feeding claws are arranged alternately in the front and back and upper and lower directions so as not to be interfered by the non-return claws of the cartridge body. The four non-return claws provided at the front and rear and upper and lower portions of slider 150 are configured so as to be pulled back by the elasticity of the plane plate. Thus, the slider 150 can be moved toward right side, in the adverse direction to the feeding direction, without any interference.

[Clip-arranged belt]

The clip-arranged belt 200 is, as shown in FIG. 3, formed by winding a belt of film 201, to which the plurality of clips 101 are adhered for connecting, so as to be a role. The film 201 tends to tear in the direction of width and the material of clip 101 is metal, thus, the film 201 is cut every time when the clip 101 is bent with the clamp.

[Control circuit]

Figure 17:
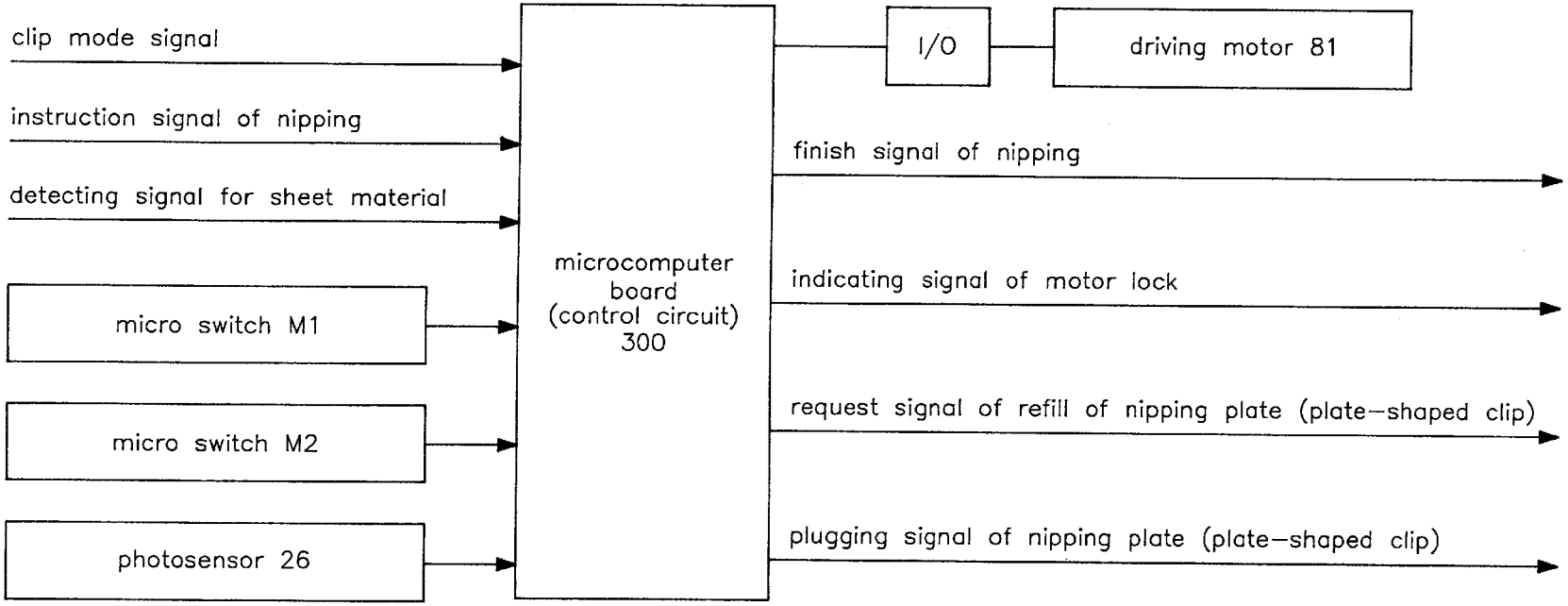
FIG. 17 is a block diagram showing input/output signals of the sequence control unit.

FIG. 17 shows a sequence control unit 300 as a control circuit, which controls rotation angle and rotation amount of the driving motor 81. This sequence control unit 300 is usually named as a board computer, CPU board, microcomputer board or the like, and it is a board, on which peripheral circuits such as microcomputer, connecting circuit and the like are mounted. Then, the sequence control unit 300 carries out microcomputer control for the driving motor 81. The driving motor 81, which comprises a DC motor, is driven through the means of interface of sequence control unit. As the inputs at the data input side of the sequence control unit 300, there are output from the micro switch M2, output from photosensor 26, output from the micro switch M1 as a clip detecting sensor at the clamp side, the clip mode signal and clip instruction signal from the copying machine, and detecting signal for the sheet materials contained in, for example a stack tray for copy papers and the like. As the outputs of sequence control unit 300, there are control signal of rotation angle and the signal of rotation direction of the driving motor 81, and signals of nipping-finish, clip plugging, request for clip supplying, motor lock and the like, these signals indicating the situation of the clipping device 10. Then, when the clip-set detecting means detects that the clip cannot be set in the clamp, the sequence control unit 300 serves as output means for indicating such situation, that is the clip is not set in the pair of clamps. Electrical feed is carried out for the sequence control unit 300 on the basis of electric power supply from the copying machine. The start flag of clip mode is determined on the basis of nipping instruction signal from the copying machine.

FIG. 1 shows a flow chart of operation by the sequence control unit 300. Referring to the flow chart of FIG. 1, FIG. 2(A) (1) to (5), and FIG. 2 (B) (1) to (6), the flow chart of feeding operation by the slider 150 and the flow chart of the sequence control unit 300 will be explained. Depending on the determination of the start flag, electrical feed is carried out for the micro switch M1, M2 and photosensor 26 and, judgment is carried out whether the concave portion 90A of disk-shaped convex portion of cam 90 locates at the position of micro switch M2 or not (S1). In this step S1, if the concave portion 90A locates at the position of micro switch M2, initialize is not required. On the other hand, if the concave portion 90A does not locate at the position of micro switch M2, initialize is carried out by controlling the driving motor 81 so that the concave portion 90A of the cam 90 locates at the position of micro switch M2 (S2).

Figure 2A:
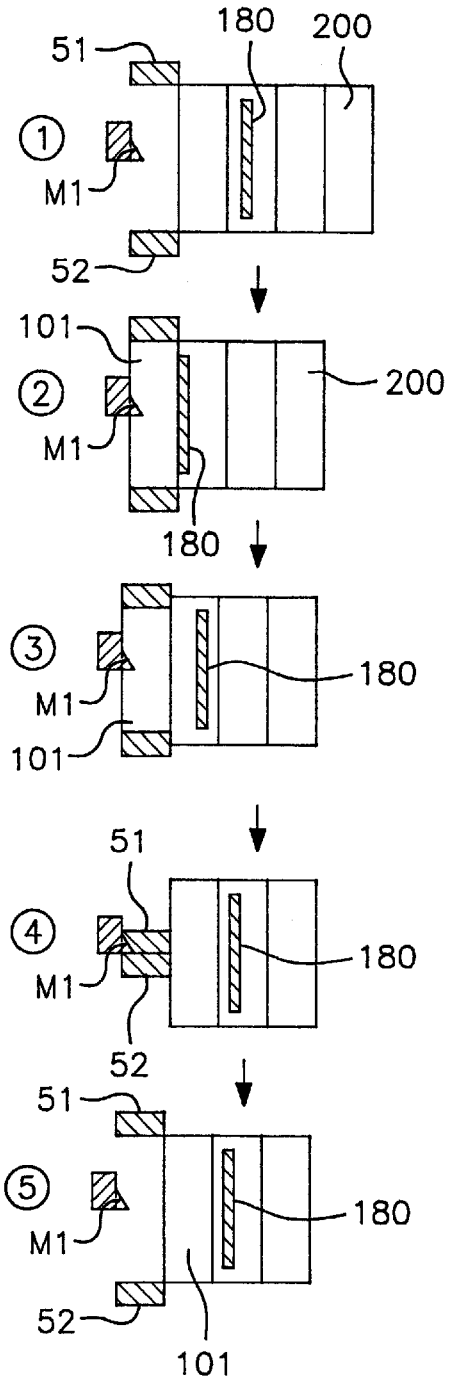
FIG. 2(A) is an explanatory drawing showing a feeding operation of the slider which does not re-feed a clip-arranged belt of clips when the clip-arranged belt is fed to a pair of clamps.
Figure 2B:
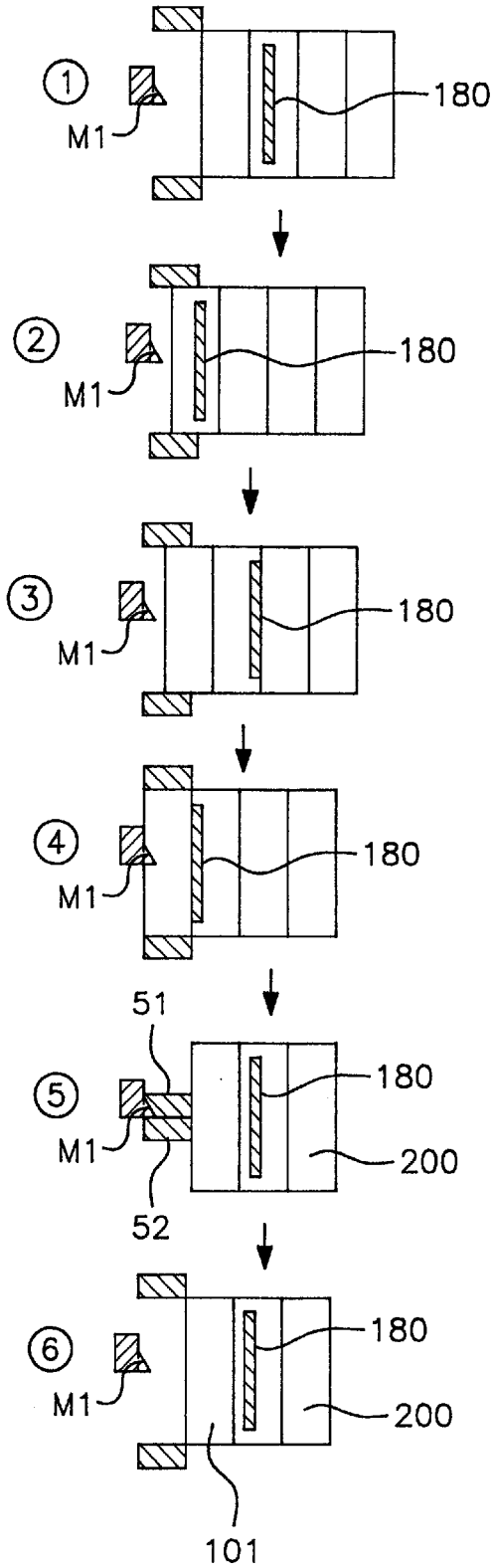
FIG. 2(B) is an explanatory drawing showing a feeding operation of the slider which re-feeds a clip-arranged belt of clips when the clip-arranged belt is fed to the clamps.

On that time, the slider 150 locates at a stand-by position of FIG. 2(A)(1) or FIG. 2(B)(1) and the clip 101 locates to be adjacent to the clamp portion 51, 52.

When the micro switch M2 is turn on and the concave portion 90A locates at the position of home position HP, normal rotation signal CW(1) is sent to the interface of driving motor 81 so that the slider 150 can be moved from adjacent position to the photosensor 26 to the adjacent point to the micro switch M1 (S3). Precisely, according to the normal rotation signal CW, the driving motor 81 allows cam 90 to rotate. The rotation of cam 90 enables the arm portion 36 to swing through the means of arm portion 31A and the slider 150 to reciprocate from the photosensor 26-side to the micro switch M1-side.

When the driving motor 81 rotates the cam 90 in the normal rotation direction, comparing is carried out between the elapsed time $T\alpha$ passed from the time when the micro switch M2 turns on, and the predetermined time T0 (S4).

If it is found that the elapsed time $T\alpha$ passed from the time when the micro switch M2 turns on, exceeds the predetermined time T0, judgment is carried out whether the micro switch M2 turns on or off (S5), and if it is found that the micro switch M2 does not turn on but keeps to turn on, motor-lock is indicated (S6).

When the micro switch M2 turns off, comparing is carried out between the next elapsed time $T\beta$ passed to the time when the clip 101 is detected by the micro switch M1, and the predetermined time T1 (S7). If it is found that the elapsed time $T\beta$ exceeds the predetermined time T1, judgment is carried out whether the micro switch M1 turns on or off (S8). Then, if is found that the micro switch M2 turns on, it means that the clip 101 is set in the clamp portions 51, 52. Therefore, the driving motor 81 is rotated continuously so that the slider 150 can be reciprocated between the photosensor 26 and clamp portions 51, 52.

Thus, as shown in FIG. 2(A)(2), the clip 101 is carried so to be placed between the clamp portions 51, 52. Then, the rotation of driving motor 81 makes the clamp portions 51, 52 to be closed (See FIG. 2(A)(3)) so that the sheet materials S can be nipped so as to be fastened by the clip 101 (See FIG. 2(A)(4)).

Comparing is carried out between the elapsed time Tγ passed from the time when the micro switch M1 detects the clip 101, to the time when the slider 150 returns back to the stand-by position adjacent to the photosensor 26, and the predetermined time T2(S9).

In the step S9, if it is found that the elapsed time Tγ exceeds the predetermined time T2, judgment is carried out whether micro switch M2 turns on or off (S10). If it is found that the micro switch M2 does not turn on, motor lock is indicated (S11). In the step S10, if it is found that the micro switch M2 turns on, the numerical value N of adverse rotation transaction counter of driving motor 81 is reset to be zero (S12) for finish (END). This allows the clamp portions 51, 52 to be opened, as shown in FIG. 2(A)(5).

In the determination step S8, when judgment is carried out whether the micro switch M1 turns on or off by the existence of clip 101, if it is found that the micro switch M1 is kept to turn off, it means that the clip 101 does not reach at the micro switch M1, as shown in FIG. 2(B)(2). In this case, 1 is added to the numerical value N of adverse rotation transaction counter of driving motor 81 (S13), and judgment is carried out whether the photosensor 26 turns on or off (S14).

If the photosensor 26 turns on, comparison operation is carried out between the numerical value N of adverse rotation transaction counter and numerical value 10 (S15), if it is found that the adverse rotation transaction N does not exceed the value 10, the instruction of adverse rotation CCW is sent (S16).

According to the adverse rotation instruction CCW of the driving motor 81, as shown in FIG. 2(B)(3), the slider 150 returns to the photosensor 26-side. If it is found that the adverse rotation transaction N exceeds 10, it means that the slider 150 reciprocates 10 times, and the signal representing that the clip 101 is plugged somewhere is output (S17).

In the step (S14) of judgment whether the photosensor 26 turns on or off, if it is found that the photosensor 26 is turned off, comparison operation is carried out between the numerical value N of adverse rotation transaction counter and numerical value 2 (S18), if it is found that the adverse rotation transaction N exceeds 2, the signal representing that the clip does not exist in place, is output (S19). If it is found that the adverse rotation transaction N does not exceed the value 2, return to the step S16.

Measurement is carried out for the elapsed time Tδ since the time when the signal instructing the adverse rotation of driving motor 81 is sent, and comparing is carried out between the elapsed time Tδ and the predetermined time T3 (S20). If it is found that the elapsed time Tδ exceeds the predetermined time T3, judgment is carried out whether the driving motor 81 is rotated in the adverse direction so as to return to the home position HP and the micro switch M2 is turns on, or the micro switch M2 is kept to turn off (S21). If it is found that the micro switch M2 is kept to turn off, motor-lock is indicated (S22). If it is found that the micro switch M2 turns on, the driving motor 81 is rotated in the adverse direction and return to the step S1 so that the driving motor 81 is rotated in the normal direction. By doing so, as shown in FIG. 2(B)(4), the clip 101, which has been stopped in the middle, is engaged between the step portions of push members 280, 280 of clamp portions 51, 51.

After the clip 101 is set in the clamp portions 51, 52, the steps following the step S4 are performed. FIGS. 2(B)(4) to (6) show, only by re-feeding, that the clip 101 sets in the clamp portions 51, 52 so as to be bent, in the same way as the steps following FIG. 2(A)(3).

Figure 16:
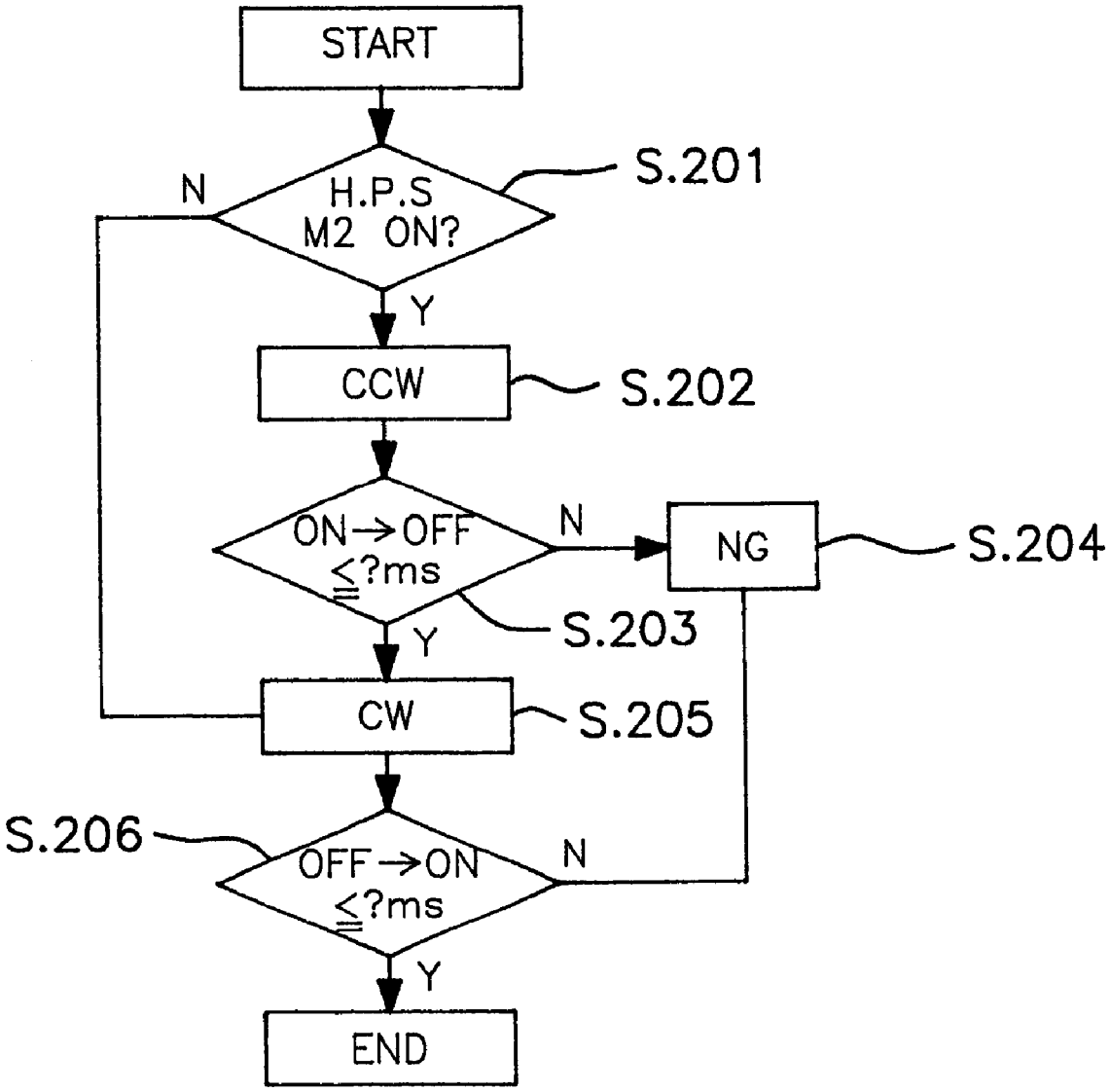
FIG. 16 is a flow diagram showing the initialization of the sequence control unit.

As shown in FIG. 16, the initialize (S2) is performed in the following. Precisely, after the initialize flag is determined, judgment is carried out whether the micro switch M2 turns on or off (S201). Then, if it is found that the micro switch M2 turns on, the driving motor 81 is rotated in the adverse direction (S202). Comparing is carried out between the elapsed time T on-off passed between the time when the micro switch M2 turns on and off, and the predetermined time Tη (about 600 ms) (S203). If it is found that the elapsed time T on-off exceeds the predetermined time Tη, it is indicated that motor-lock or sensor-trouble is caused (S204). On the other hand, if it is found that the elapsed time T on-off does not exceed the predetermined time Tη, the driving motor 81 is rotated in the normal direction (S205). After the normal rotation of driving motor 81, comparing is carried out between the elapsed time T on-off and the predetermined time Tζ (about 600 ms) (S206). If it is found that the elapsed time T on-off does not exceed the predetermined time Tζ, the initialize is finished. If it is found that the elapsed time T on-off exceeds the predetermined time Tζ, it is indicated that motor-lock or sensor-trouble is caused (S204).

In the initialize step S3, if the concave portion 90A of cam 90 shown in FIG. 8(B) corresponds to the area where the rotation in the adverse direction is possible and which is oriented toward the micro switch M2, the driving motor 81 is rotated in the adverse direction (arrow CCW) until the edge portion α is brought into contact with the micro switch M2. Then, when the micro switch M2 is turned off due to the contact of edge portion α and micro switch M2, the driving motor 81 is rotated again in the normal direction (arrow CW) until the micro switch M2 turns on again. In the initialize step S3, when the area, where rotation in the adverse direction is impossible, is brought into contact with the micro switch M2, within the circumferential area except the concave portion 90A, the driving motor 81 is rotated in the normal direction until the edge portion α is brought to the position of micro switch M2.

In adverse rotation step S16, the driving motor 81 is rotated in the adverse direction (arrow CCW) until the edge portion α is brought into contact with the micro switch M2. Then, when the micro switch M2 is turned off due to the contact of edge portion α and micro switch M2, the driving motor 81 is rotated in the normal direction (arrow CW) by returning step 3.

[Operation]

Now, mechanical operation of clipping device will be explained totally.

First, the cover body 120 of cartridge 100 is operated, the clip-arranged belt 200 is loaded in the storage chamber 102.

Next, while the fore end of clip-arranged belt 200 is located outside the cartridge 100, it is guided between the slider 150 and cartridge body 103, for closing the cover body 120.

Then, the cartridge 100 is attached to the table 13 of device body 11. By attaching of cartridge 100 to the table 13, the engaging piece 110 of cartridge 100 is inserted in the engaging port 19 of the table 13, and the projection 110A of engaging piece 110 is engaged to the engaging portion 22A of engaging piece 22. Finally, the cartridge 100 can be attached to the device body 11.

At the same time, locking claw piece (not shown) of cartridge 100 is inserted into the unlocking port 18 of table 13 so that the slider 150 is unlocked due to the projection 18A of unlocking port 18. Further, engaging projection 36A of arm portion 36 is guided into the guide portions 157, 157 of slider 150 so as to be inserted between the engaging portions 158 and 158.

Before the driving motor 81 is driven, the driving cam 85 and cam 90 are placed at the initial position shown in FIG. 3, while the slider 150 is placed at the home position in FIG. 3. Here, the sensor 26 detects the film 201 of clip-arranged belt 200, which means that the clip 101 exists in place. Further, the micro switch M2 detects the concave portion 90A of cam 90, and the clamp portions 51, 52 are placed at the home positions shown in FIG. 8 while they are opened.

In this situation, nipping signal is sent from the copying machine body (not shown) and the bundle of sheets S is mounted on the step portion 28A of external wall 28, the top surface Va of the front wall portion V in the housing 12 and the like. Since the photosensor 26 detects that the clip 101 exists in place, the sequence control unit 300 controls of the driving of driving motor 81 on the basis of nipping signal. Driving of driving motor 81 allows the driving cam 85 to rotate in the clockwise direction (counter clockwise direction in FIG. 8, clockwise direction in FIG. 12) through the means of gear 83 and reduction gear train 84.

The rotation of driving cam 85 allows the fore end portion of arm portion 31A of the first link member 31 to insert into the smaller diameter portion 86A of the cam channel 86, whereby, the arm portion 31A of the first link member 31 pivots in the clockwise direction CW in FIG. 13 (counter clockwise direction in FIG. 8(A)). Accompanied with the first link member 31, the second link member 32 pivots, which leads pivot in the direction of arrow CW in FIG. 14 (counter clockwise direction) of arm portion 36 of the second link member 32. According to the pivot of arm portion 36, the slider 150 moves from the photosensor 26-side to the micro switch M1-side.

The movement of slider 150 makes the fore end portion of front feeding claws to engage to the fore front clip 101. Then, as the slider 150 moves, the clip 101 is carried to the clamp portions 51, 52-side. In this situation, if the rear feeding claws of the rear feeding claw plate 195 in the slider 150 engage to another clip 101, the clip-arranged belt 200 can be carried with the front feeding claws and rear feeding claws.

Since each clip 101 is connected each other with the film 201, the clip 101 is carried from the cartridge 100 to the clamp portions 51, 52.

Further, the rotation of driving cam 85 leads the front portion 31*b* of arm portion 31A in the first link member 31 to come to adjacent to the minimum diameter portion 86*d* (See FIG. 13) of cam channel 86. Then, the slider 150 moves to the left-side, whereby the clip 101 is carried so as to be brought into contact with the stopper 29. When the clip 101 is brought into contact with the stopper 29, the movement of slider 150 is stopped and the clip 101 turns to be held by the projections 73B, 77B of clamp members 51, 52. On that time, the micro switch M2 detects the clip 101 held by the clamp members 51, 52.

Continuously, the fore end portion of arm portion 31A in the first link member 31 reaches at the minimum diameter portion 86*d* of the cam channel 86, which makes the first link member 31 to pivot. However, the slider 150 is stopped by the stopper 29 (See FIG. 12). Accordingly, only the first link member 31 pivots relatively to the second link member 32 against the spring force of spring 37.

The amount of pivot performed by the first link member 31 is determined so that the slider 50 moves with a distance exceeding the width of clip 101. Even if there is scattering in gaps between the adjacent clips 101, 101, since the first link member 31 pivots relatively to the second link member 32, such scattering is absorbed. Finally, the clip 101 can be surely carried to the predetermined position.

Next, the fore end portion 31*b* of arm portion 31A moves from the minimum diameter portion 86*d* to the larger diameter portion 86B by the rotation of driving cam 85. This causes the pivot of first link member 31 in the counter clockwise direction in FIG. 12 (clockwise direction in FIG. 2). Accompanied with the first link member 31, the second link member 32 pivots in the same direction, finally, the slider 150 returns to the home position in the photosensor 26-side.

When the slider 150 returns to the home position, the clip 101 is prevented from returning back together with the slider 150, because of non-return claw attached to the guide plate portion 130 of device body 11. During the returning of slider 150, since the non-return claws are provided on the upper and lower portions of the guide plate portion 130, the clip 101 is prevented from leaning.

On the other hand, the cam 90 pivots together with the driving cam 85. Here, the smaller diameter portion R1 of cam 90 corresponds to the portion 86C of cam channel 86 in the driving cam 85 (See FIG. 13). Hence, when the slider 150 reciprocates, the smaller diameter portion R1 of cam 90 is brought into contact with the shaft 62, while the clamp members 51 and 52 are kept so as to be opened.

Next, the driving cam 85 is further rotated so that the fore end portion 31*b* of arm portion 31A moves in the larger diameter portion 86B of cam channel 86, and the shaft 62 is brought into contact with the circumferential surface of increasing diameter portion R2 of the cam 90. By such movements, the clamp pivot member 53 pivots in the clockwise direction in FIG. 8(A) around the shaft 63 as the supporting point. According to this pivot, the clamp members 51, 52 become to close. At the same time, this pivot makes the clip 101 to proceed forward and bend so as to be V-shaped.

Further, the rotation of driving cam 85 allows the shaft 62 of clamp pivot member 53 to slide on and contact with the circumferential surface of increasing diameter portion R2 toward the larger diameter portion R3. This allows the clamp portions 51, 52 to be closed further, whereby, the clip 101 is twofold.

In this situation, while the fore end portions of push members 280 push the clip 101 from its top and bottom sides, the clamp members 51, 52 allow the clip 101 to be locked inwardly. Thus, this bending clip 101 nips the bundle of sheets S so as to be fastened while the clip 101 attaches tightly to the bundle of sheets S. That is to say, since the both ends of clip 101 are prevented from lifting from the bundle of sheets S, the bundle of sheets S can be nipped and bound surely.

The rotation of driving cam 85 allows the shaft 62 of clamp pivot member 53 to slide on and contact with the circumferential surface of the decreasing diameter portion R4. In this situation, the clamp pivot members 53 pivot in the clockwise direction around the shaft 63 as the supporting point, whereby, the clamp members 51, 52 are pivoted so as to be opened, contrary to the above. Then, after one rotation of driving cam 85 and cam 90, the clamp members 51, 52 return to the home positions shown in FIG. 8(A). The micro switch M2 detects the concave portion 90A of cam 90, which causes the stop of driving motor 81.

When the cartridge 100 is removed from the table 13 of device body 11, the clip 101 is not pulled out and not projected from the device, because the slider 150 is attached to the cartridge 100. Therefore, when the cartridge 100 is attached again to the device, there is no fear of inconvenience on such attaching which would be caused by the projected clip 101. Additionally, since it is not required to cut the projected clip 101 away before attaching the cartridge 100, all of clips 101 can be used completely without waste.

When the cartridge 100 is removed from the table 13, the slider 150 is locked with a lock mechanism, thus, the clip 101 is prevented from flowing off together with the moving slider 150.

In order to refill the cartridge 100 with a new clip-arranged belt 200, the front fore end of new clip-arranged belt 200 is fixed to the rear end of clip-arranged belt 200 remained in the carrying path. By doing so, each clip 101 of new clip-arranged belt 200 can be carried by the rear feeding claws of the slider 150, while each clip of remained clip-arranged belt 200 can be carried by the front feeding claws. Accordingly, the remained clip-arranged belt 200 can be used completely.

In this embodiment, the explanation has been made about the cartridge 100 which is included in the clamp device 10. However, it is needless to say that the present invention is not limited to this type of cartridge, but may be applied to, for example, the cartridge of electrical stapler.

As stated in the foregoing, the clipping device 10 in this embodiment comprises: the cartridge 100, which loads the clip-arranged belt 200; the pair of clamp portions 51, 52, which grip the fore front clip 101 of clip-arranged belt 200 from the top and bottom sides of clip 101 so that the clip 101 is bent; the slider 150, which reciprocates between the cartridge 100 and the pair of clamp portions 51, 52 so that the clip-arranged belt 200 can be carried from the cartridge 100 to the pair of clamp portions 51, 52; a sequence unit 300, which controls the driving of pair of clamp portions 51, 52 and slider 150; and a micro switch M1, which detects whether the clip 101 of clip-arranged belt 200 is set between the pair of clamp portions 51, 52; and the clipping device 10 is characterized with that when the clip 101 is not set between the pair of clamp portions 51, 52, the sequence unit 300 makes the slider 150 to carry out the predetermined number of operations for feeding the clip-arranged belt 200, while the pair of clamp portions 51, 52 are prevented from bending the clip 101, and if the clip 101 of clip-arranged belt 200 cannot be set between the clamp portions 51, 52 during these predetermined number of operations for feeding the clip-arranged belt 200, the sequence unit 300 also stops the driving of pair of clamp portions 51, 52 and slider 150.

Precisely, when the clip 101 is not set between the clamp portions 51, 52, the sequence unit 300 makes the slider 150 to carry out the predetermined number of operations for feeding the clips 101, then, if the clip 101 is not set between the clamp portions 51, 52 during these predetermined number of operations, bending operation of clamp portions 51, 52 can be stopped. Therefore, damage to the sheet materials and clamp portions 51, 52, which would be caused by nipping operation of clipping device containing no clip, can be prevented. The clip 101 can be separated by utilizing pressure caused by bending operation of clamp portions 51, 52, but it may be separated with a cutter and the like.

Additionally, if the number of operations for feeding the clip-arranged belt 200 by the slider 150 is counted and when the clip 101 is not set between clamp portions 51, 52 during the number of operations, the display indicating, that the clip 101 is not set, is shown in the manual board and the like of copying machine for an operator of this machine.

Further, when the photosensor 26 detects that there is no clip 101 in the cartridge 100 and the micro switch M1 placed at the clamp portions 51, 52-side detects that the clip 101 does not exist in place, on the basis of output from the sequence control unit 300, the display indicating, that there is no clip-arranged belt 200 at the cartridge-side, is shown for the instruction of clip-refill. When although the cartridge 100 has the clips 101, there is no clip in clamp portions 51, 52-side, if the clip 101 cannot be detected between the clamp portions 51, 52-side during the predetermined number of operations for feeding slider 150, on the basis of output from the sequence control unit 300, the display indicating, that the clips are plugged in the area where the slider 150 can be moved, is shown.

The clip set detecting means comprises a micro switch, photosensor or the like. They are provided so as to be adjacent to the clamp. The output from this means is used for controlling means which drives clamps such as motor, cylinder and the like. This controlling means may be defined by not only micro computer control circuit but also electric circuit, relay sequence circuit and the like.

As the output means for the results of clip set detecting means, indicating means provided on the clipping device itself can be used. Alternatively, display instructing the un-set of clip can be shown on the indicating means of operation panel and the like of the machine, to which the clipping device is attached, such as copying machine, facsimile terminal equipment, and the like.

Second Embodiment

The subjects related to the second embodiment is stated in the following.

A clip-arranged belt loaded in a clipping device is defined by connecting a plurality of plate-shaped clips with a film and the like. A slider, which supplies a clip between the clamps of clipping device, moves with a distance (L) for clip-supply. The distance (L) equals to the amount of clip's width (L1) plus the gap's width ($\Delta$ L1); $L=L1+\Delta L1$ However, there is scattering in gaps between adjacent clips. It is normal that the average $\Delta$ Lx of gap's width $\Delta$ L1 is obtained on the basis of conventional products. When the gap $\Delta$ Ln between adjacent clips is larger than the $\Delta$ Lx with a predetermined allowance, it means that more clips are required to be fed. On the other hand, when it is smaller than the $\Delta$ Lx with a predetermined allowance, it means that too much clips are fed. When more clips are required, it is difficult to adjust such situation. It might be anticipated that the maximum amount $\Delta$ Lmax of conventional products is used as the $\Delta$ Ln and that a stopper is used for stopping the clip or slider against the case where too much clips are fed. However, by doing so, the slider stops in the middle of feeding operation, leading a problem that driving means for reciprocating the slider is locked. Accordingly, the clipping device in accordance with the second embodiment has the object to supply the clip surely so as to be placed in the predetermined position between the clamps as well as the object to prevent the driving means from being locked, which would be caused from the scattering in gaps between the connected clips.

Now, the cartridge in accordance with the second embodiment of present invention will be explained referring to the drawings. In FIGS. 18 to 21, the reference numerical 410 is a clipping device, which is attached to, for example, a copying machine. The clipping device 410 comprises a device body 411 and a cartridge 500, which is attached removably to the device body 411.

A housing 412 of device body 411 includes a reciprocating mechanism 430, which reciprocates a slider 550 attached to the cartridge 300; a clamp mechanism 450, by which the clip 501 is bent; and a driving mechanism 480, which drives the reciprocating mechanism 430 and clamp mechanism 450.

[Housing]

As shown in FIGS. 22 to 25, the housing 412 is provided with a table 413 on which a cartridge 500 is mounted. At the side of table 413, there is a clamp chamber 414, which includes a clamp mechanism 450. In the housing 412, there are also a gear chamber 415 and cam chamber 416 under the table 413 and clamp chamber 414.

The table 413 is provided with an arm port 417, which is extended in the transverse direction (in FIG. 22), an unlocking port 418, which is extended in the transverse direction and whose width changes in two steps, and an engaging port 419, which is extended in the front and back direction and which has the large width at its center.

On the side surface 418A of unlocking port 418, a projection 418B is formed. The projection 418B has a slope 418*b* formed so as to be projected from the port 18 longer as it goes downward (See FIG. 32).

On the under surface of table 413, a holding portion 420 is formed. A screw 421 is applied to be mated with this holding portion 420. An engaging piece 422 is attached to the screw 421 so as to be moved along the screw 421. The engaging piece 422 is urged in the direction toward the right side (in FIG. 20) by means of spring 423 attached to the screw 421. On the top side of engaging piece 422, an engaging portion 422A is formed so as to project to the left side (in FIG. 22). The engaging portion 422A is inserted into the engaging port 419. There is a predetermined gap between the engaging portion 422A and engaging port 419 in the transverse direction (in FIG. 20 and 22).

A guide rail 424 is formed over the table 413 so as to extend in the vertical direction along the side wall 414A, which forms a clamp chamber 414. At the front side of top surface of table 413, a supporting member 425 is provided so as to project upward from the top surface of table 413. The supporting member 425 is provided with a sensor 426 comprising a light emitting diode 426A and light receiving diode 426B.

Figure 30:
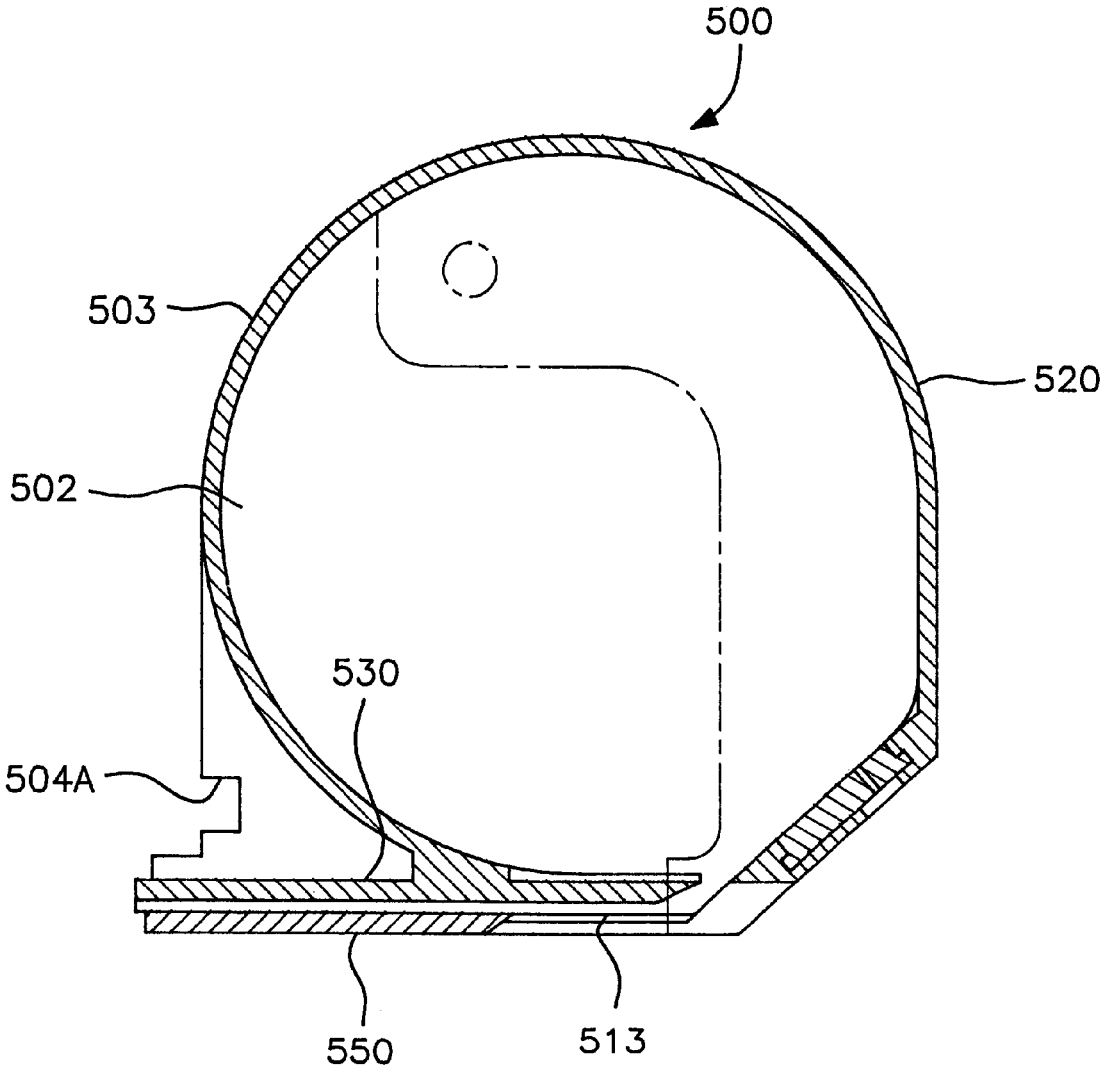
FIG. 30 is a sectional view showing a cartridge.

By this sensor 426, the light emitted from the light emitting diode 426A is reflected at a film 601 of clip-arranged belt 600 located on a carrying path 513 (FIG. 30) of cartridge 500 stated below. Then, the reflected light is received by the light receiving diode 426B for detecting whether the clip 501 exists or not. Since the reflected light at the film 201 is used for such detection, it can be performed surely. Precisely, if the reflected light from the clip 501 is used for such detection, when the sensor 426 is located in the gap between the clip 501 and clip 501, it would be impossible to detect the clip 501.

At the front end portion of table 413, a front wall portion V is formed. At the front end portion of side wall 428 in the housing 412, a step portion 428A is formed on which the bundle of sheets S is mounted. The top surface Va of the front wall portion V, step portion 428A and top surface 425*a* of the supporting portion 425 have the identical level so that the bundle of sheets S can be mounted.

Inside of side wall 428, there is a stopper 429, which stops the clip 501 fed with the slider 550 at the predetermined position, and a micro switch M1, which detects that the clip 501 is fed to the predetermined position. The reference symbol M2 is a micro switch, which detects whether a driving cam 485 explained below is returned to an initial position (home position). This micro switch M2 detects a concave portion 490A, which is formed on the side portion of cam 490 explained below also, hence, this switch M2 can detect that the driving cam 485 is returned to the initial position (home position).

[Driving mechanism]

The driving mechanism 480 comprises the driving motor 481, which is attached to the side wall 412A of housing 412; a gear 483, which is provided on the driving shaft 482 of this driving motor 481; a reduction gear train 484, which is applied so as to be mated with this gear 483 and which has reduction gears 484A to 484D; and the driving cam (link driving means) 485, which has gear teeth applied so as to be mated with the reduction gear train 484. The gears 483, 484A to 484 D are placed in the gear chamber 415 of housing 412. The driving cam 485 is placed in the cam chamber 416.

Figure 26:
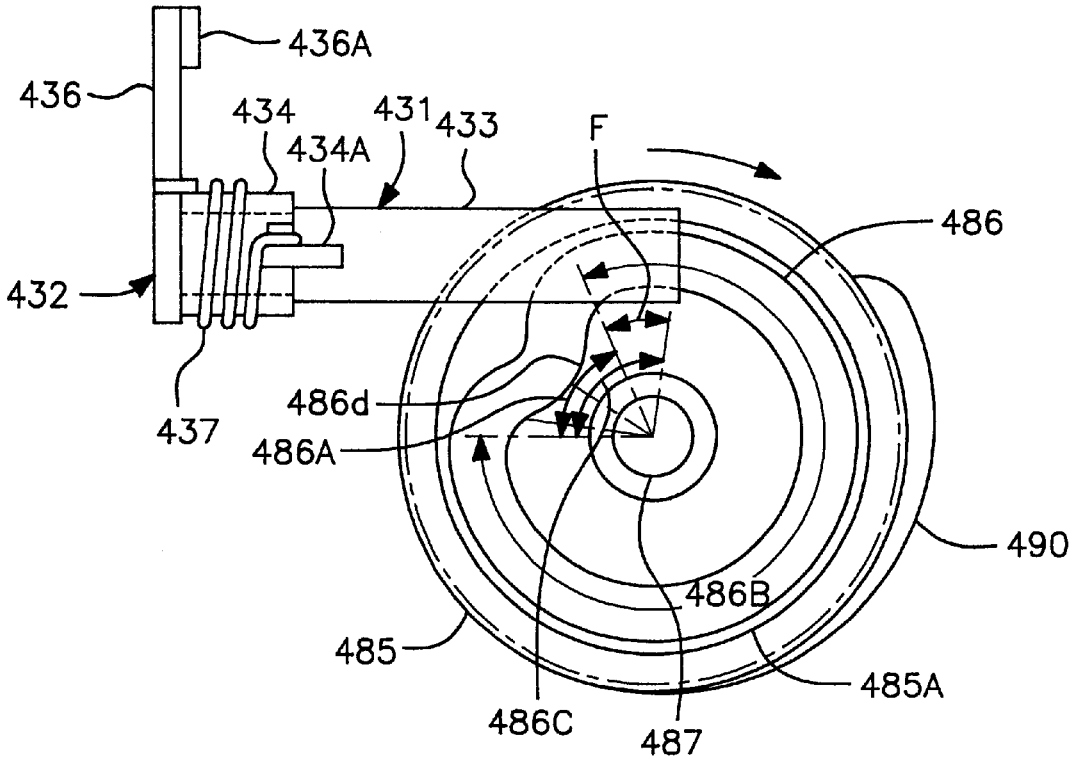
FIG. 26 is an explanatory drawing showing the construction of a moving mechanism.

The driving cam 485 is rotated in the direction of arrow shown in FIG. 26, through the means of gears 483, 484A to 484 D, with the driving motor 481.

On the one side surface 485A of the driving cam 485, as shown in FIG. 26, an annular cam channel 486 is formed. The cam channel 486 has a smaller diameter portion 486A, which has decreasing distance between the center of rotary shaft 487 and the circumference of the portion 486A, and a larger diameter portion 486B, which has the same distance between the center and the circumference of this portion 486B.

The driving cam 485 is provided integrally with the cam 490, which is rotated together with the driving cam 485.

Figure 29:
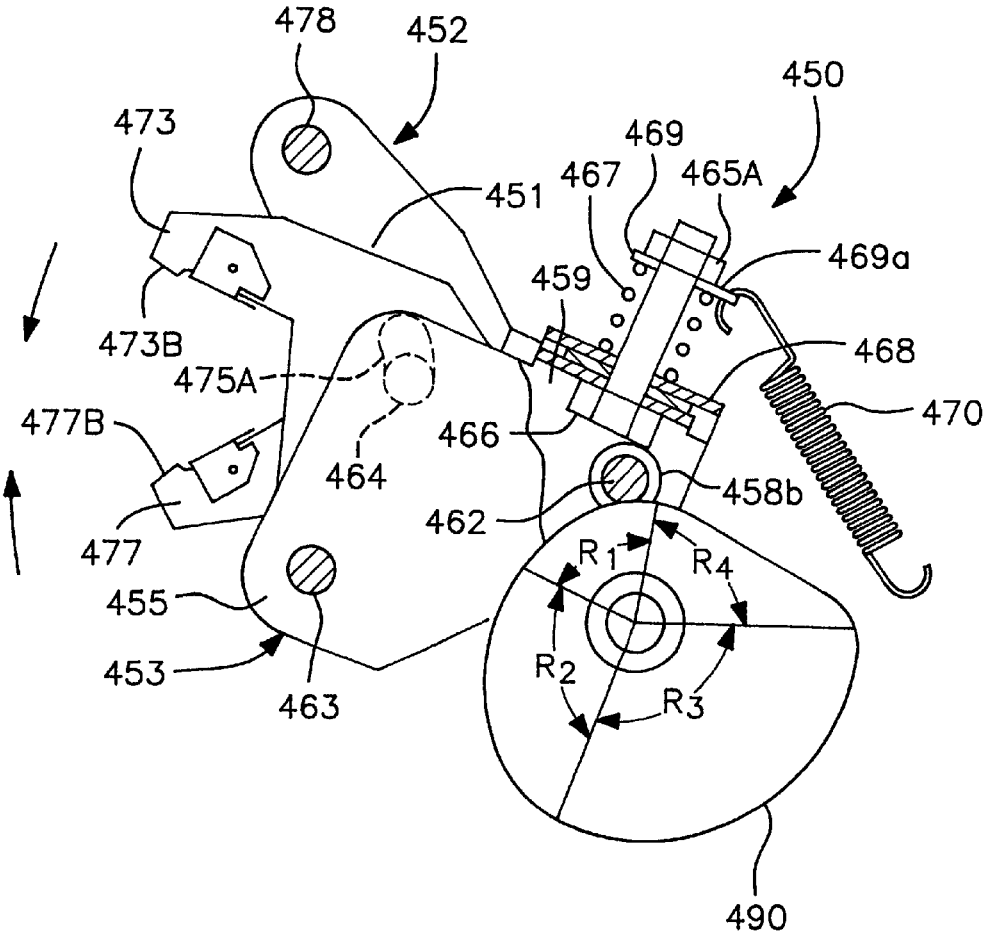
FIG. 29 is a conceptual drawing showing the construction of a clamping mechanism.

As shown in FIG. 29, in the cam 490, a small diameter portion R1, whose diameter is minimum; an increasing diameter portion R2, whose diameter is increased; a large r diameter portion R3, whose diameter is maximum; and a decreasing diameter portion R3, whose diameter is decreased, are provided. Then, the smaller diameter portion R1 corresponds to a portion 486C, which includes the home position F and smaller diameter portion 486A (See FIG. 26).

[Moving mechanism]

Figure 27:
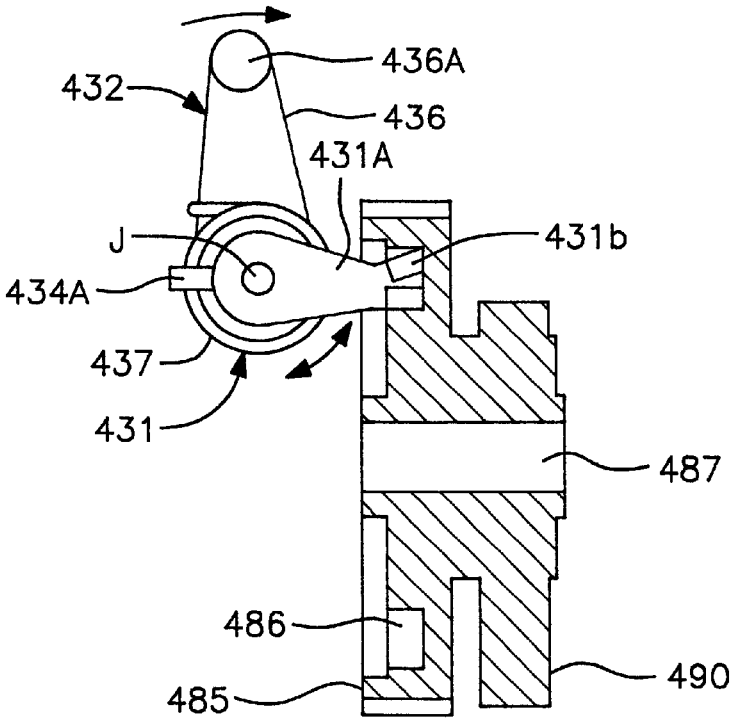
FIG. 27 is an explanatory drawing showing the construction of the moving mechanism.
Figure 28:
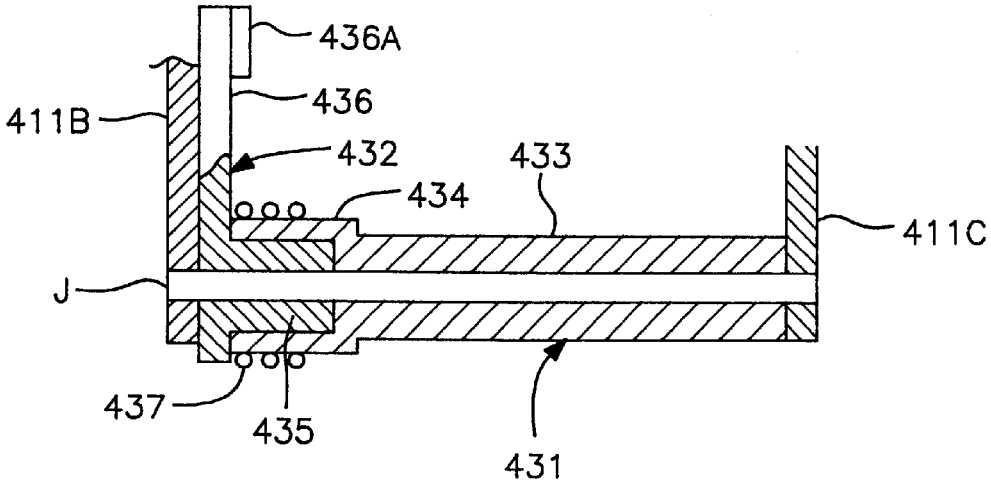
FIG. 28 is a sectional view showing the construction of a link mechanism.

A moving mechanism (link means) 430 comprises, as shown in FIGS. 26 to 28, the first link member (driving link member) 431 and second link member (reciprocating link member) 432, which are attached pivotably to the shaft J and to the supporting portion 412B, 412C of the housing 412.

The first link member 431 comprises a shaft portion 433, which has an arm portion 431A having the fore end portion 431*b* inserted into the cam channel 486; and a cylinder portion 434, which is formed so as to be continuous to the one end of this shaft portion 433. Then, the rotation of driving cam 485 allows the vertical movement of fore end portion 431*b* of arm portion 431A through the means of cam channel 486, whereby the first link member 431 can be pivoted around the shaft J in the direction of arrow shown in FIG. 27.

The second link member 432, as shown in FIG. 28, comprises a shaft portion 435, which is engaged pivotably in the cylinder portion 434; and an arm portion 436, which is extended upward from the shaft portion 435. An engaging projection 436A is formed at the top of arm portion 436.

A coil spring (absorbing meaning) 437 is provided so as to be wound around the external surface of cylinder portion 434 of first link member 431. The one end of coil spring 437 is engaged and fixed to an engaging projection 434A formed on the first link member 431, while the other end of coil spring 437 is engaged and fixed to the arm portion 436 of second link member 432. This coil spring 437 causes the pivot of second link member 432 together with the first link member 431. When the pivot of first link member 431 is stopped, only the first link member 431 turns to pivot relatively with the second link member 432.

Figure 19:
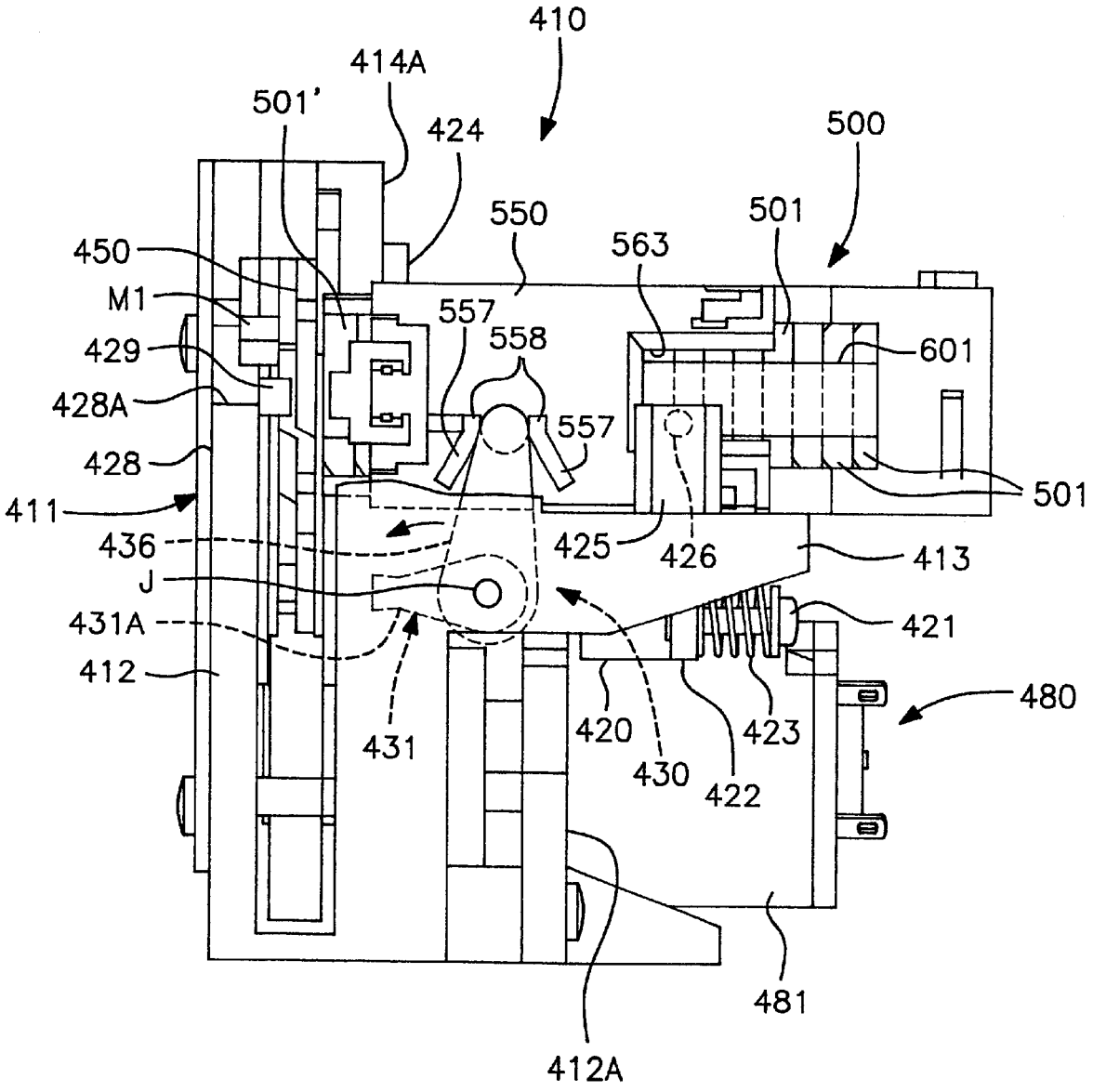
FIG. 19 is a front elevation of the clipping device of FIG. 18.

Accompanied with the pivot of second link member 432, the arm portion 436 is pivoted so that the slider 550 can be reciprocated in the transverse direction in FIG. 19.

[Clamp mechanism]

A clamp mechanism 450 comprises, as shown in the conceptual drawing of FIG. 29, a pair of clamp members 451, 452; clamp pivot members 453, between both of which the clamp members 451, 452 are placed; and a shaft 462, which is attached to the clamp pivot members 453 and which is brought into contact with the circumferential surface of the cam 490.

The clamp pivotation member 435 can be pivoted around the shaft 463 serving as the supporting point and is urged in the clockwise direction (in FIG. 29) by the spring 470 around the shaft 463. By such urging, the shaft 462, which is attached to the clamp pivotation member 435, is always brought into contact with the circumferential surface of the cam 490.

[Clamp member]

As shown in FIG. 29, the clamp member 451, which includes a clamp portion 473 and projection 473B provided on the clamp portion 473, is pivoted integrally with the clamp pivot member 453 around the shaft 463 serving as the supporting point.

The clamp member 452, which includes a clamp portion 477 and a circular arc-shaped ellipse port 475A, can be pivoted around the shaft 478. The shaft 464 of clamp pivot member 453 goes through the ellipse port 475A. The shaft 464 can move relatively along the ellipse port 475A. The ellipse port 475A is configured so that the clamp members 451, 452 can be moved symmetrically.

Accordingly, by the pivot of clamp member 451 in the counter clockwise direction (in FIG. 29) together with the clamp pivot member 453 around the shaft 463, the clamp member 452 turns to pivot in the clockwise direction (in FIG. 29) around the shaft 478.

The clamp portion 477 and the clamp portion 473 of clamp member 451 are faced each other. A projection 477B is formed on the clamp portion 477 so as to be projected upward. The clip 501, which is fed out by the slider 550 stated below, is held at its both ends by the projection 477B of clamp portion 452 and the projection 473B of clamp portion 451.

Then, the rotation of clamp members 451, 452 around the shaft 463, 478 as the supporting points allows the clamp portions 473, 477 to be closed, whereby the clip 501 becomes to be bent. Then, the bending portion of bent clip 501 is locked inwardly by the clamp members 451, 452. The driving motor 481 is controlled by a control circuit (not shown), which controls the driving motor 481 on the basis of, for example, nipping signal output from the copying machine body, detecting signal output from the sensor 426 and the like.

[Cartridge]

The cartridge 500 comprises a cartridge body 503, which defines a substantially circular-shaped storage chamber 502; and a cover body 520, which is provided so as to be opened and closed on the cartridge body 503.

Figure 20:
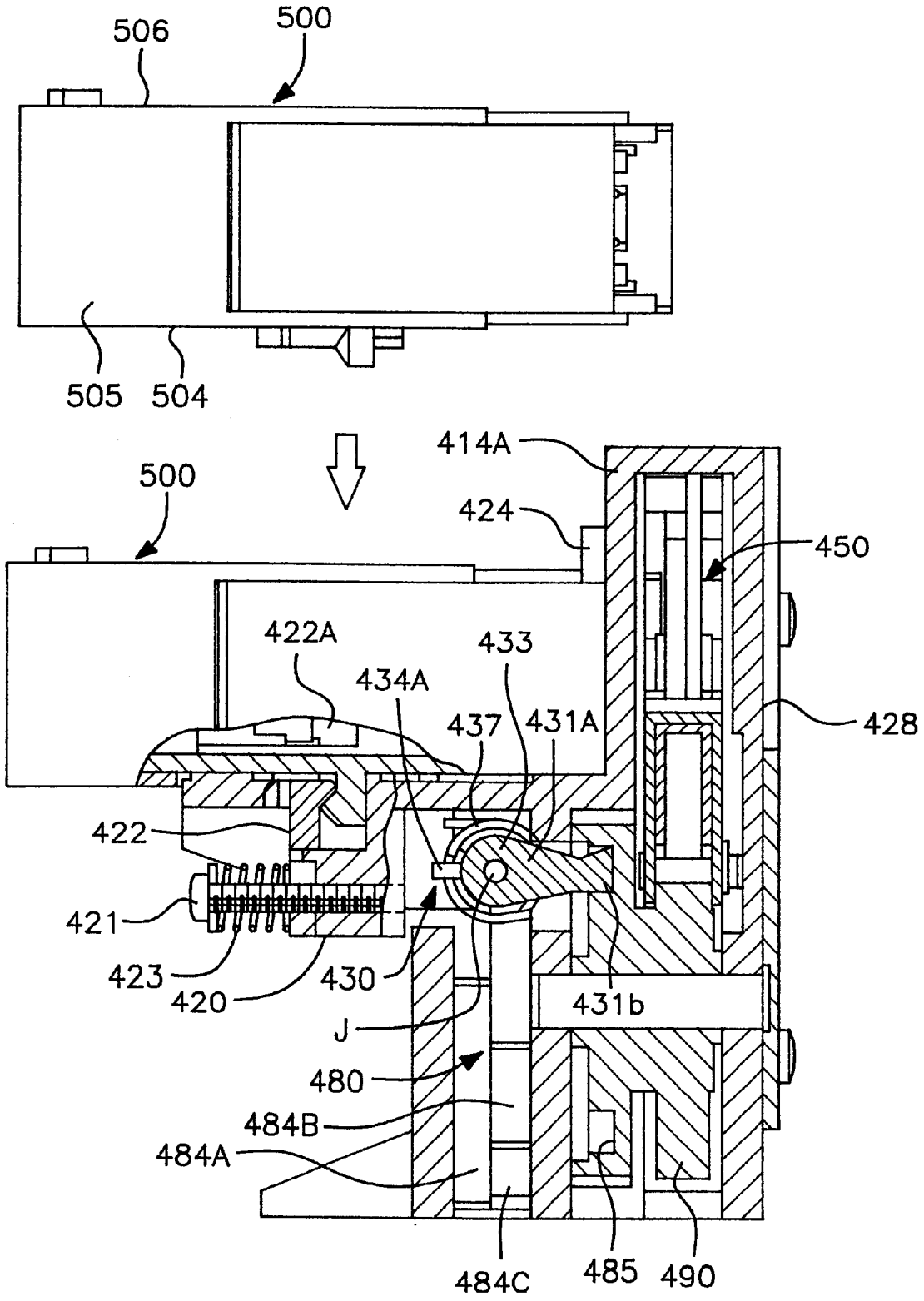
FIG. 20 is a sectional view showing the clipping device of FIG. 18.
Figure 21:
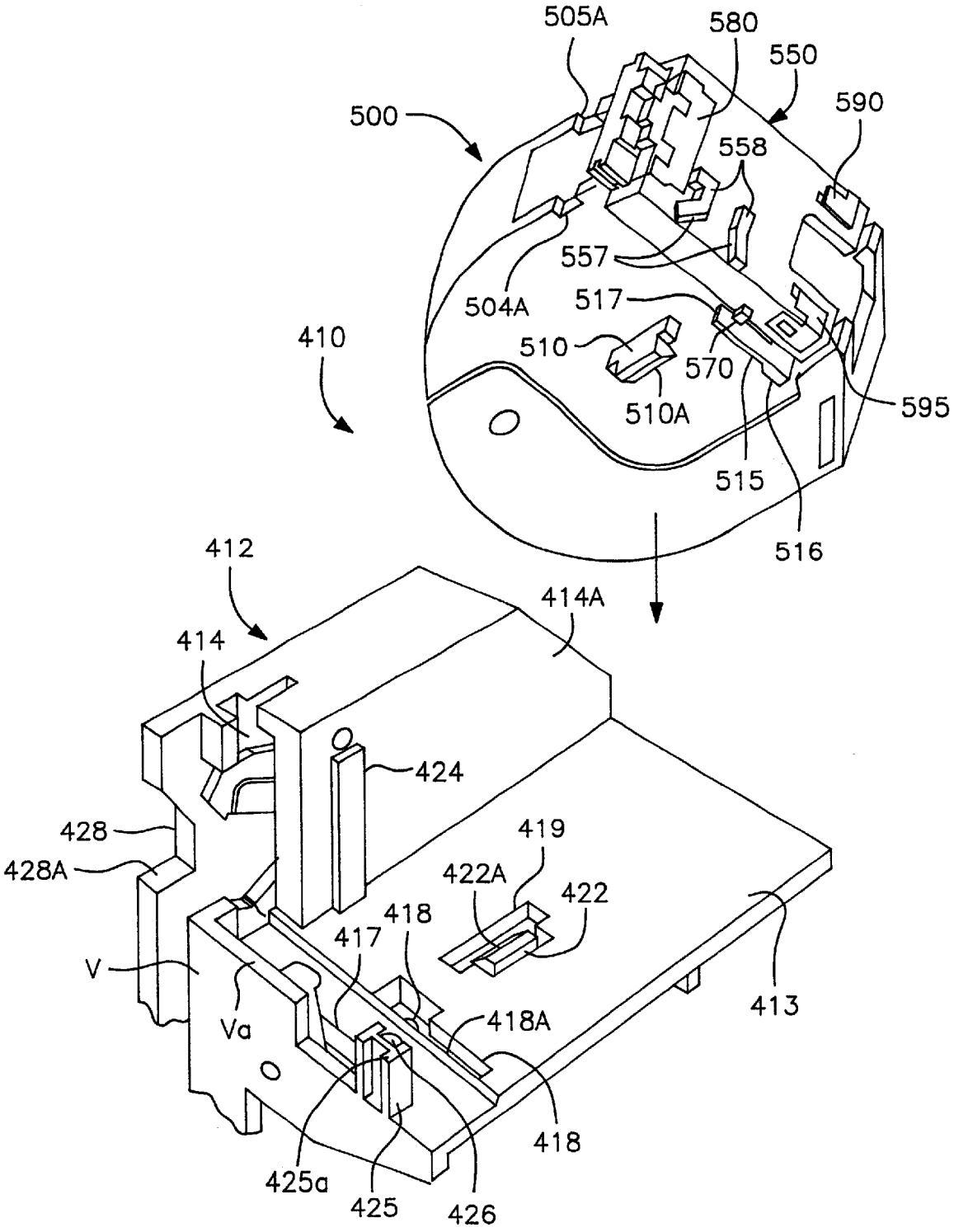
FIG. 21 is a perspective view showing a device body of the clipping device and a cartridge.
Figure 22:
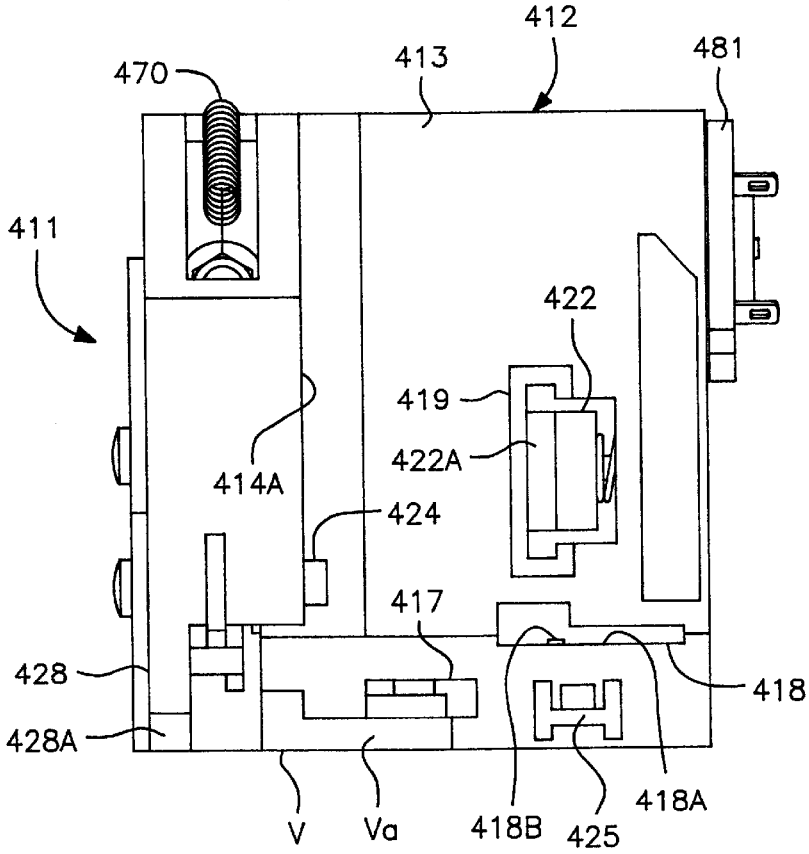
FIG. 22 is a plan view showing the device body.
Figure 23:
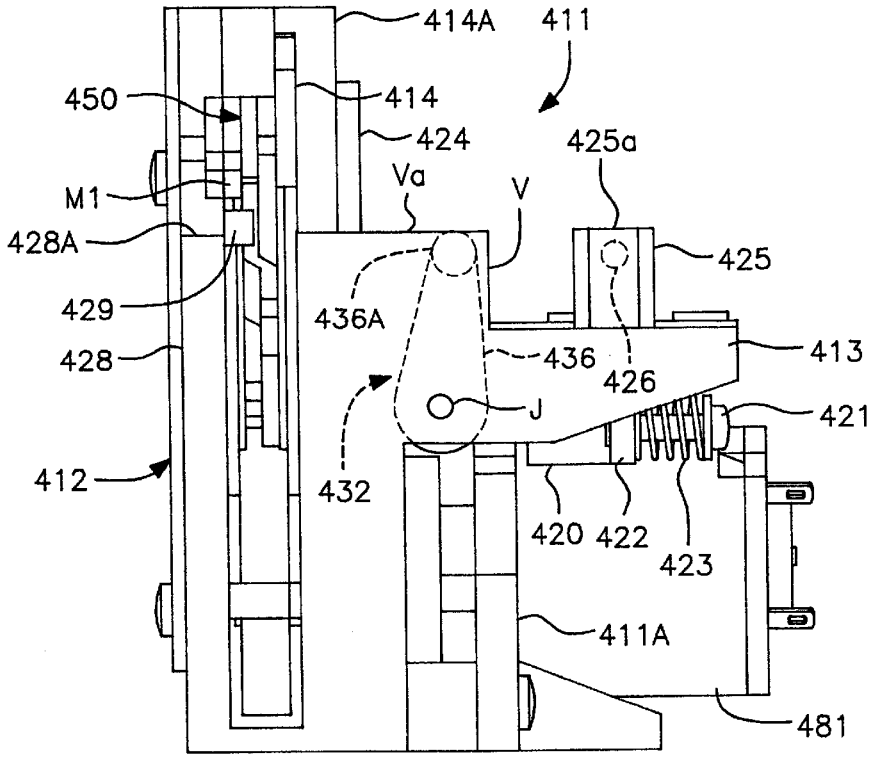
FIG. 23 is a left side elevation showing the device body.
Figure 24:
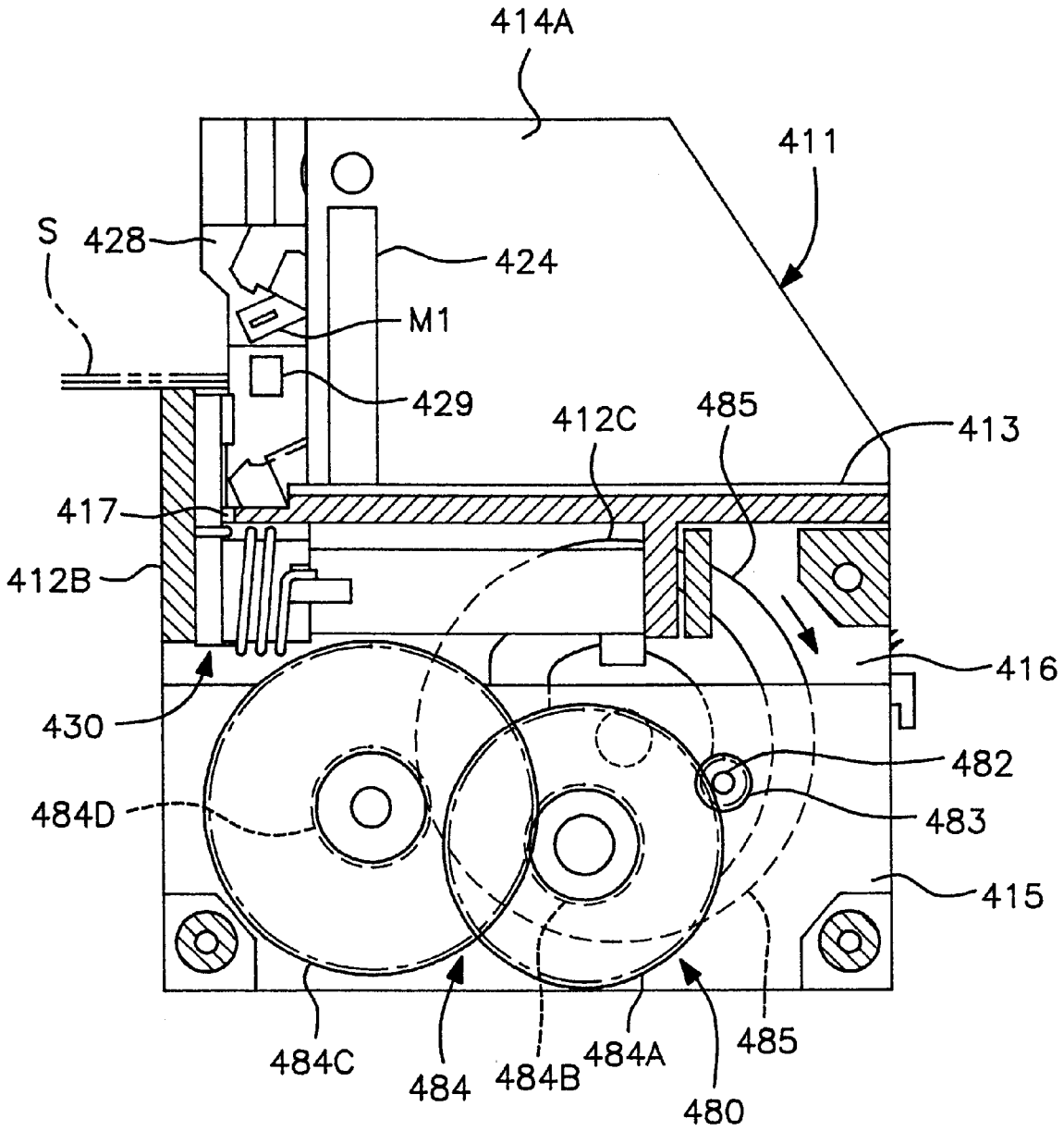
FIG. 24 is an explanatory drawing of a driving mechanism mounted in the device body.
Figure 25:
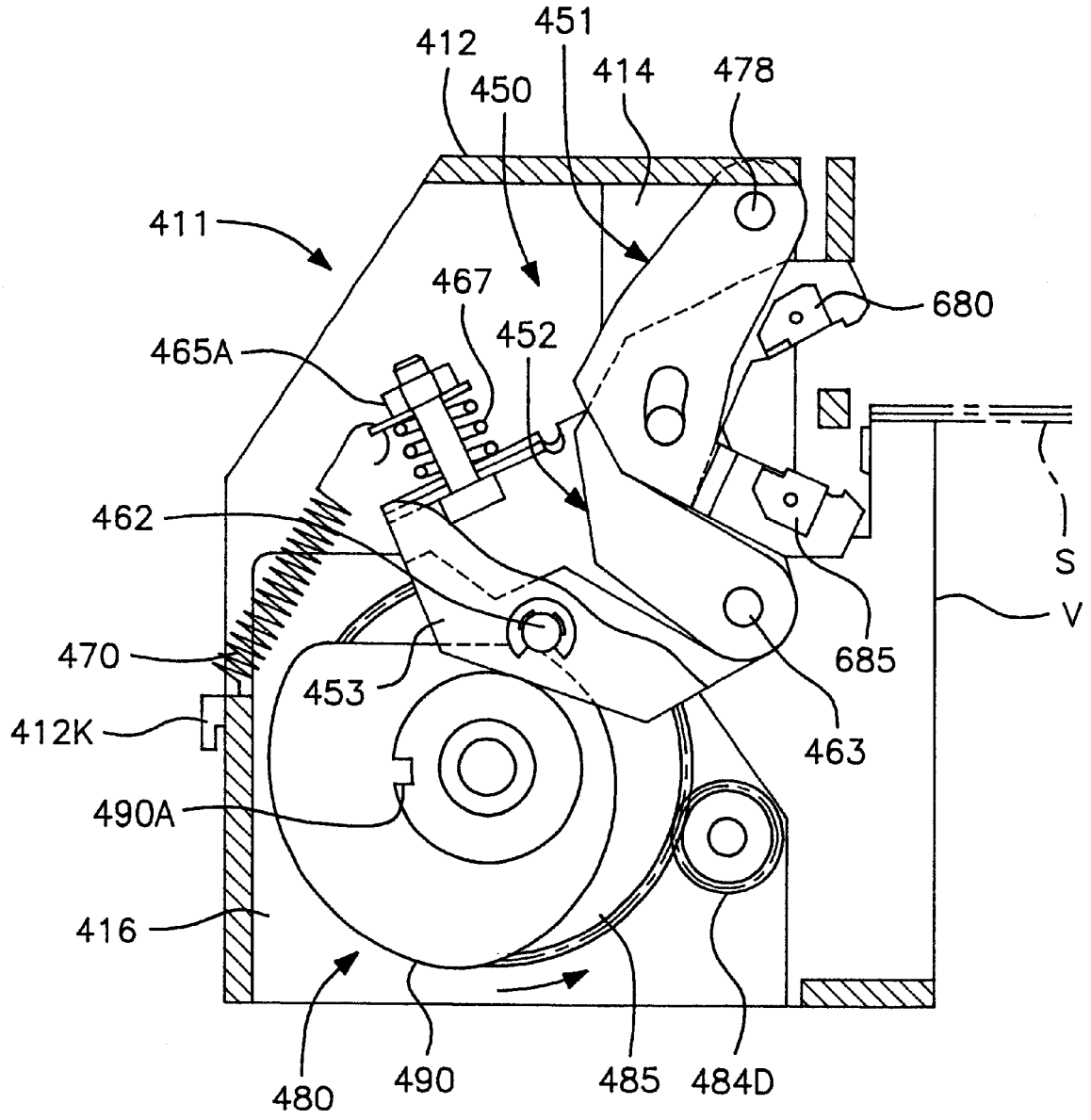
FIG. 25 is an explanatory drawing of a clamp mechanism of the clipping device.

The cartridge body 503 comprises a circumferential plate 505, which is provided so as to surround the circumference of a bottom plate 504; and a top plate 506, which is provided on the circumferential plate 505 (See FIGS. 20 and 21). An opening is formed on the circumferential plate 505 in order to open the storage chamber 502, when the cover body 520 is opened. The width of opening is approximately identical to the diameter of storage chamber 502 so that a clip-arranged belt, which is wound so as to be a role and which is stated below, can be contained easily in the storage chamber 502.

At the end portions of bottom plate 504 and top plate 506, concave portions 504A and 505A are formed, to which the guide rail 424 of device body 411 is engaged. Further, the bottom plate 504 is provided with an engaging piece 510, which has an projection 510A. The engaging piece 510 is configured so as to be inserted into the engaging port 419 of table 413 in the device body 411. By this inserting, the projection 510A of engaging piece 510 engages to the engaging portion 422A of engaging piece 422 in the device body 411.

Figure 32:
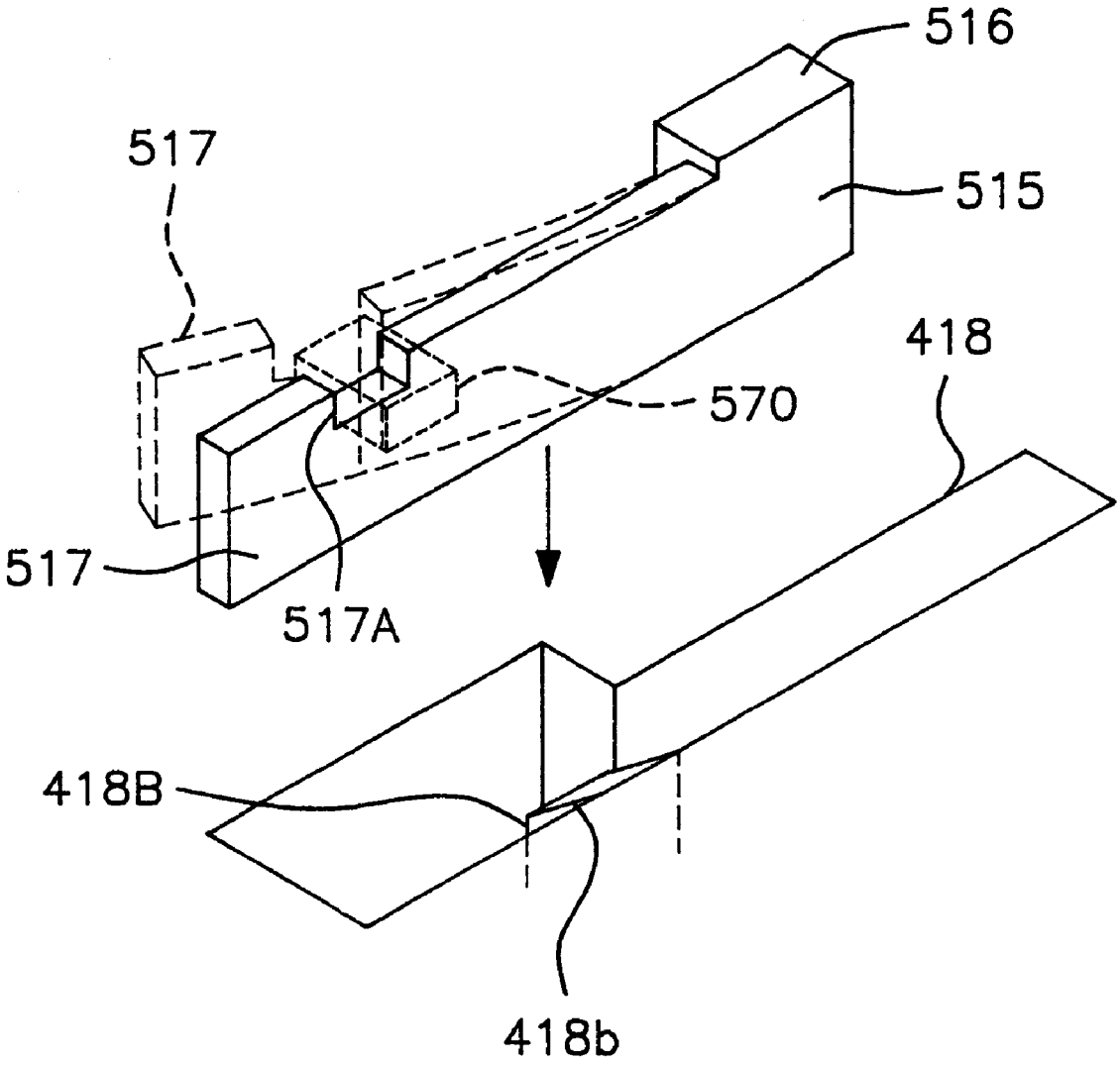
FIG. 32 is a perspective view showing a locking member.

The under surface of bottom plate 504, a locking member 515 is provided so as to be inserted into the unlocking port 418 of table 413. The locking member 515, as shown in FIG. 32, comprises a base portion 516, which is attached to the bottom plate 504; and a locking piece 517, which is deformed elastically in the broken line shown in this drawing. The locking piece 517 is provided with a concave portion 517A, to which the engaging piece 570 of slider 550 engages. When the engaging piece 570 of slider 550 engages to the concave portion 517A of locking member 515, the slider 550 is locked.

When the cartridge 500 is attached to the table 413 of device body 411, the locking member 515 is inserted into the unlocking port 418, and the locking piece 517 is deformed and moved to the position in the broken line in FIG. 32 due to the projection 418B of unlocking port 418. Thus, the engaging piece 570 of slider 550 is removed from the concave portion 517A of locking piece 517. Finally, the slider 550 is unlocked.

At the front side of cartridge body 503, a plate-shaped guide plate portion 530, which is provided with a carrying path 513 for clip 501, is formed continuously. The slider 550 is attached so as to move in the transverse direction to the guide plate portions 530.

The guide plate portion 530 is provided with non-return claw plate 540 at its back surface 530B. The fore end portion 541*a* of non-return claw 541 in the non-return claw plate 540 goes into the carrying path 513. Since the fore end portion 541*a* is configured so as to engage to the clip 501, the clip 501 is prevented from returning.

Figure 31:
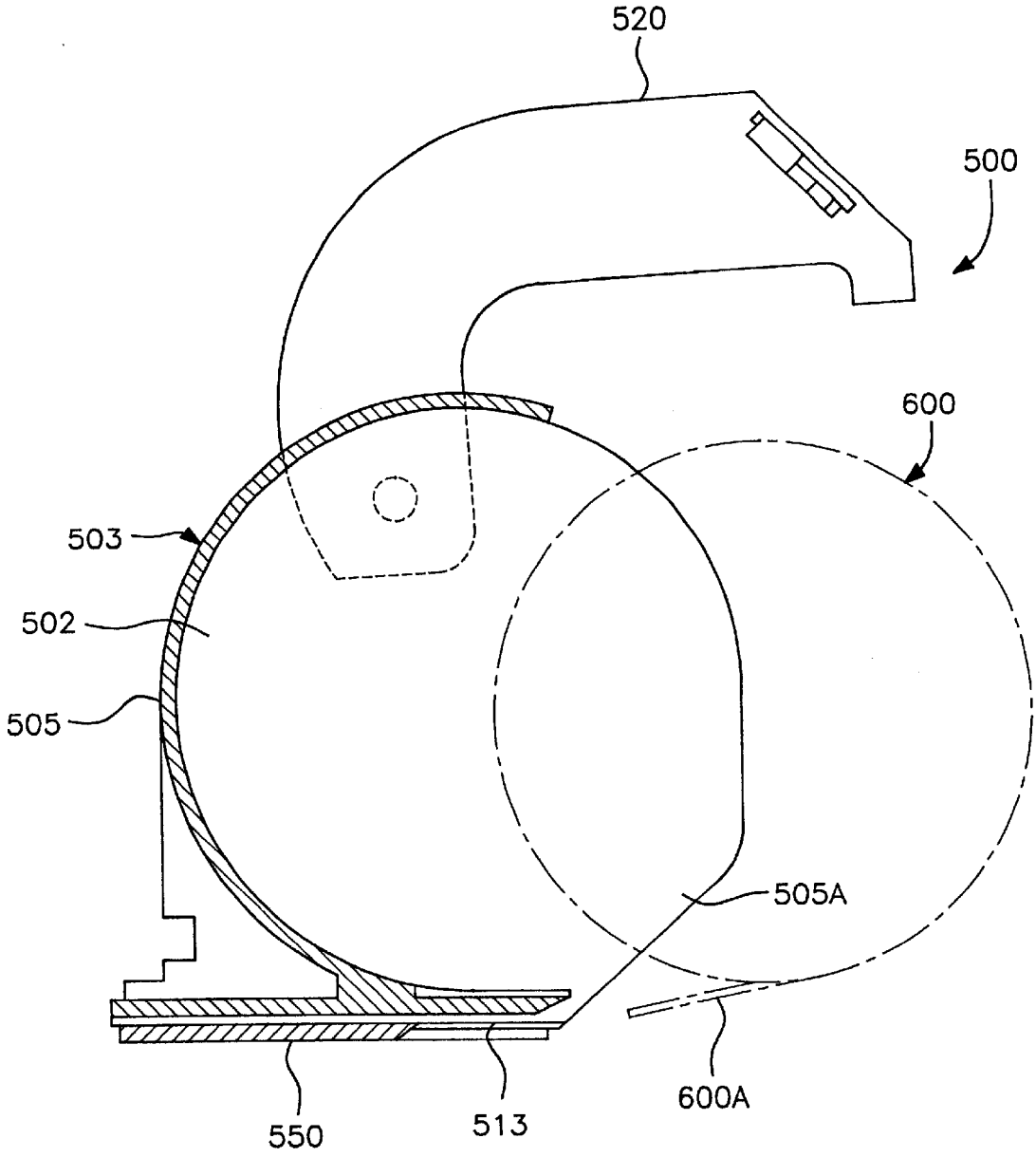
FIG. 31 is an explanatory drawing showing the cartridge whose cover is opened.

At the rear portion (right side in FIGS. 30 and 31) of guide plate portion 530, a non-return plate 540 is also attached in the similar way as stated above.

[Slider]

Figure 35:
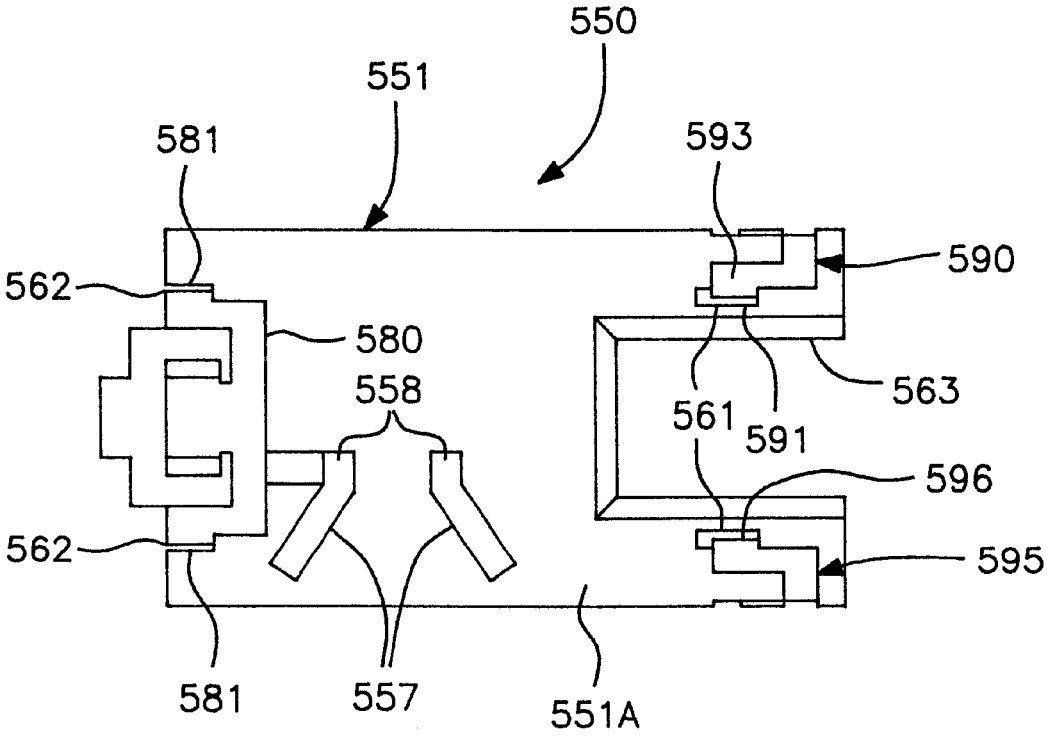
FIG. 35 is a front elevation of the slider.

As shown in FIG. 35, the slider 550 comprises a rectangular-shaped plate member 551; and trapezoid shaped guide portions 557, 557 and engaging portions 558, 558, which are provided outside of plate member 551 for guiding the engaging projection 436A of the arm portion 436 in second link member 432.

Between these engaging portions 558, 558, the engaging projection 436A of second link member 432 is inserted, which enables the arm 436 of the second link member 432 to pivot around the shaft J, thereby the reciprocation of slider 550 (See FIG. 27).

Figure 33:
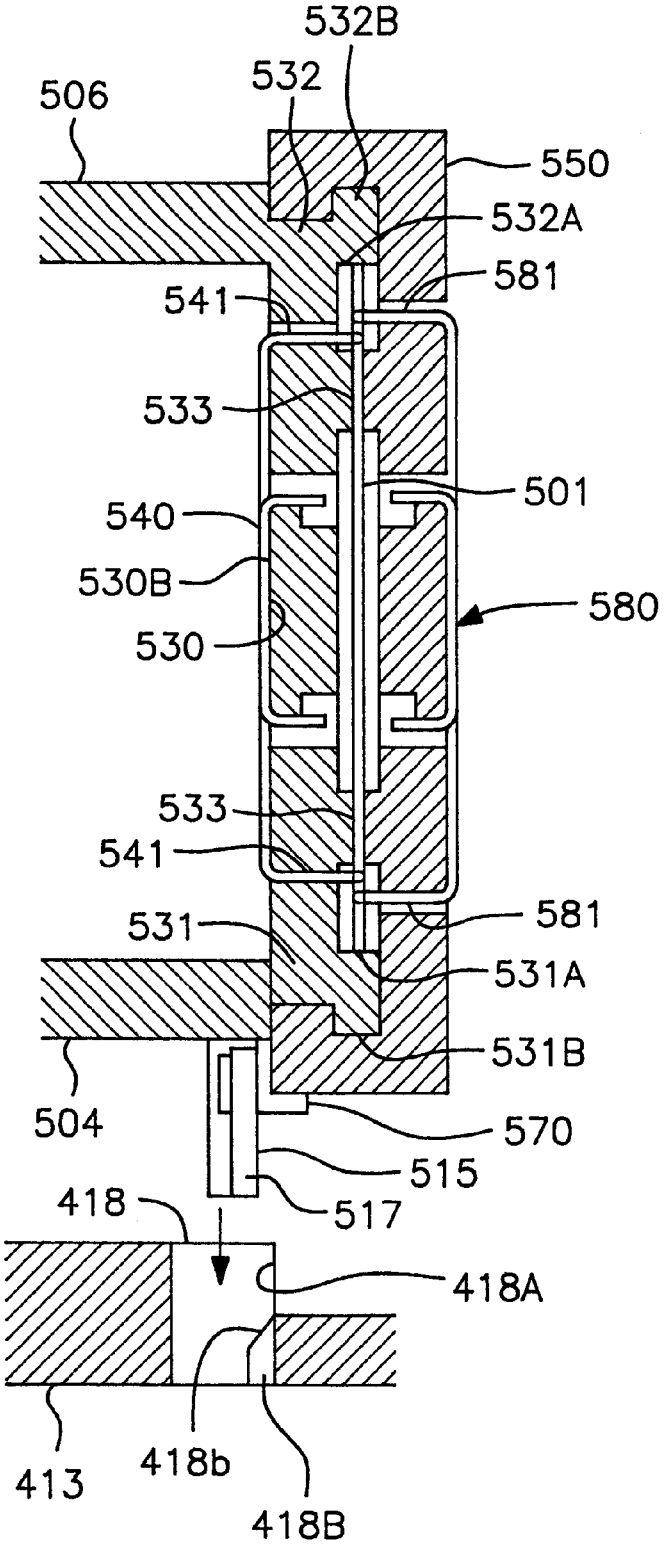
FIG. 33 is a sectional view of a guide plate and a slider.
Figure 34:
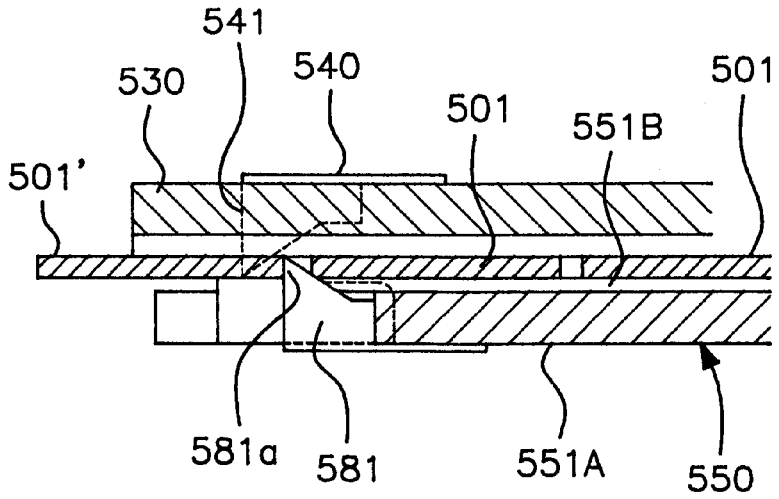
FIG. 34 is a longitudinal sectional view of the slider.

A front feeding claw plate 580 is attached to the plate member 551. Then the fore end portions 581*a* of front feeding claw 581, 581 of front feeding claw plate 580 are, as shown in FIGS. 33 and 34, projected from the internal surface 551B of plate member 551 so as to engage to the clip 501. This engagement feeds the clip 501 to the fore end-side.

In the same way, rear feeding claw plated 590, 595 are attached to the rear portion of plate member 551. The fore end portions of rear feeding claws of rear feeding claw plated 590, 595 go into the carrying path 513 so as to engage to the clip 501. The feeding claws 581 and non-return claws 541 are arranged alternately in the front and back and upper and lower directions so as not to be interfered each other.

The non-return claw 541 is configured so as to be pulled back from the carrying path 513, when the slider 550 moves toward the fore end-side in the feeding direction, while the front feeding claw 581 is configured so as to be pulled back, when the slider 550 moves back. Thus, the slider 550 can be reciprocated without any interference.

[Clip-arranged belt]

Figure 36:
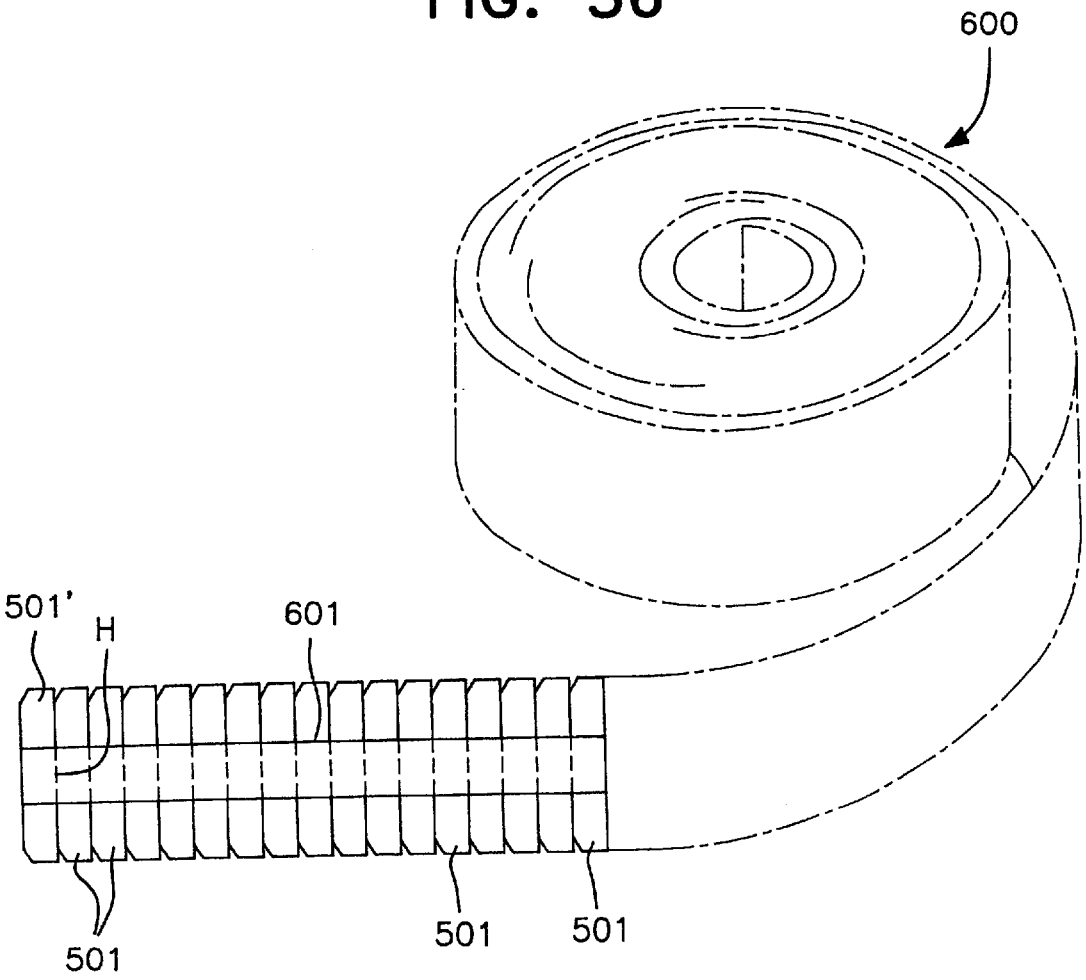
FIG. 36 is a perspective view showing the construction of a clip-arranged belt.
Figure 37:
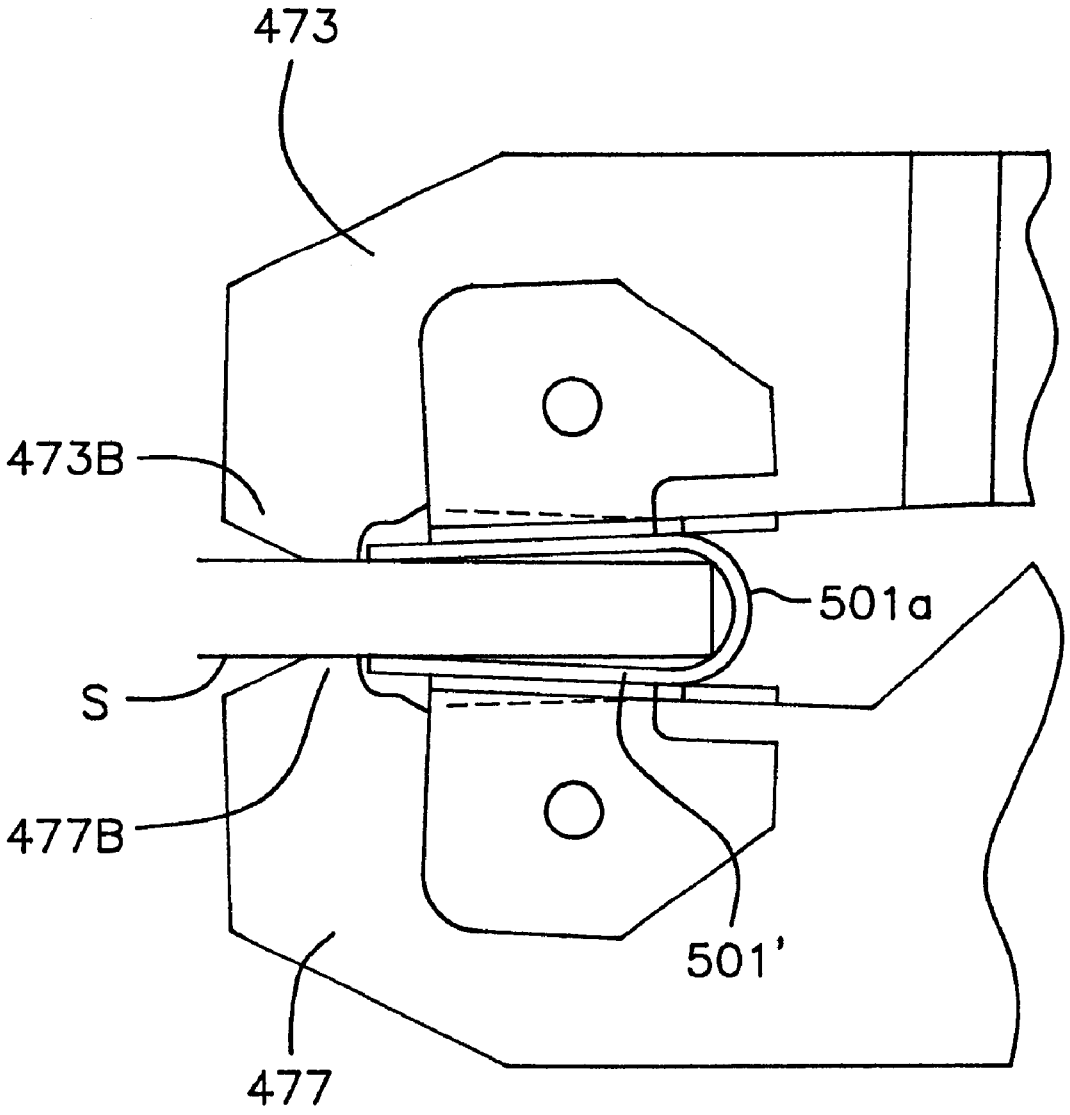
FIG. 37 is an explanatory drawing showing a clamp member and a bent clip.

The clip-arranged belt 600 is, as shown in FIG. 36, formed by winding a belt of film 601, to which the plurality of clips 501 are adhered for connecting, so as to be a role. The film 601 tends to tear in the direction of width and the material of clip 501 is metal, thus, the film 601 is cut at each broken line H every time when the clip 501 is bent with the clamp.

[Operation]

Now, the operation of clipping device having the above construction will be explained.

First, as shown in FIG. 19, the cartridge 500, which contains the clip-arranged belt 600 is attached to the table 413 of device body 411. By attaching of cartridge 500 to the table 413, the locking member 515 is deformed so as to move in the broken line of FIG. 32, resulting in unlocking of slider 550. Further, the engaging projection 436A of arm portion 436 in the moving mechanism 430 is guided by the guide portions 557, 557 so as to be inserted between the engaging portions 558, 558.

Figure 18:
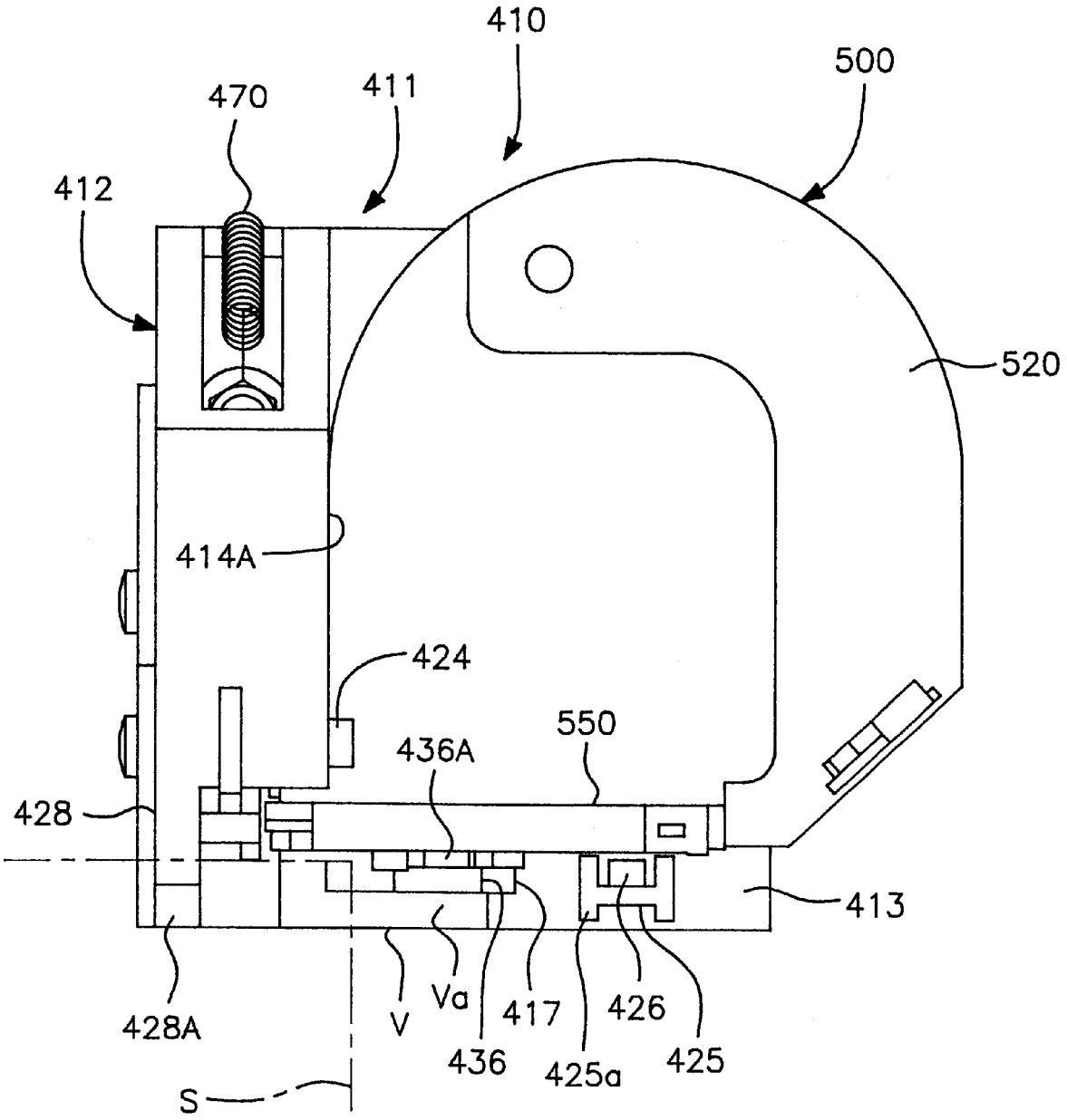
FIG. 18 is a plan view showing a clipping device according to a second embodiment of the present invention.

Before the driving motor 481 is driven, the driving cam 485 and cam 490 are placed at the initial positions shown in FIGS. 26, 27, 28, and 31, while the slider 550 is placed at the home position shown in FIGS. 18 and 19. Here, the sensor 426 detects the film 601 of clip-arranged belt 600, which is located in the carrying path 513 of the cartridge 500, which means that the clip 501 exists in place. Further, the micro switch M2 detects the concave portion 490A of cam 490, and the clamp portions 451, 452 are placed at the home positions shown in FIGS. 25 and 29.

Then, the bundle of sheets S is mounted on the step portion 428A of the external wall 428 in the housing 412 and the top surface Va of front wall portion V and the like.

In this situation, when the nipping signal is sent from the copying machine body (not shown), since the photosensor 426 detects that the clip 501 exists in place, the control circuit controls the driving of the driving motor 481 on the basis of nipping signal. Driving of the driving motor 481 allows the driving cam 485 to rotate in the clockwise direction (counter clockwise direction in FIGS. 24, 25, and 26) through the means of gear 483 and reduction gear train 484.

The rotation of driving cam 485 allows the fore end portion 431*b* of arm portion 431A in the first link member 431 to insert into the smaller diameter portion 486A of cam channel 486, whereby, the arm portion 431A of first link member 431 pivots in the clockwise direction in FIG. 20 (counter clockwise direction in FIG. 19). Accompanied with the first link member 431, the second link member 432 pivots, which leads the pivot of arm portion 436 of second link member 432 in the direction of arrow in FIG. 19 (counter clockwise direction). According to the pivot of arm portion 436, the slider 550 moves to the left side (in FIGS. 18, 19).

As shown in FIG. 34, the movement of slider 550 makes the fore end portion 581*a* of front feeding claws 581 to engage to the forefront clip 501'. Then, as the slider 550 moves, the clip 501' is carried to the fore end-side. In this situation, if the rear feeding claws (not shown) of slider 550 engage to another clip 501, the clips 501', 501 can be of carried with the front feeding claws and rear feeding claws.

Since each clip 501 is connected each other with the film 601, the clip 501 is carried toward fore end-side (left side in FIGS. 18 and 19) in the carrying path 513 so that the clips 501 in the storage chamber 502 are carried toward the carrying path 513-side.

Further, the rotation of driving cam 485 leads the front portion 431*b* of arm portion 431A in the first link member 431 to come to adjacent to the minimum diameter portion 486*d* (See FIG. 26) of cam channel 486. Then, the slider 550 moves to the left-side, whereby the clip 501' is carried so as to be brought into contact with the stopper 429. When the clip 501' is brought into contact with the stopper 429, the movement of slider 550 is stopped and the clip 501' are held by the projections 473B, 477B of clamp members 451, 452. On that time, the micro switch M1 detects the clip 501' held by the clamp members 451, 452.

Continuously, the fore end portion 431*b* of arm portion 431A in the first link member 431 reaches at the minimum diameter portion 486*d* of cam channel 486, which further makes the first link member 431 to pivot in the clockwise direction in FIG. 29 (counter clockwise direction in FIG. 19). The slider 550 is stopped by the stopper 429. Accordingly, only the first link member 431 pivots relatively to the second link member 432 against the spring force of spring 437. That is to say, the spring 437 absorbs the reciprocative driving of driving cam 485.

The amount of pivot performed by the first link member 431 is determined so that the slider 550 moves with a distance exceeding the width of clip 501 plus the maximum gap between the clips 501, 501. Accordingly, with regardless to the size of any gap between the clips 501, 501, the clip 501 can be surely carried to the predetermined position. Even if the slider 550 stops in the middle of reciprocation of first link member 431, since the first link member 431 pivots relatively to the second link member 432, the driving cam 485 is not locked but kept to rotate.

Next, the fore end portion 431*b* of arm portion 431A moves from the minimum diameter portion 486*d* to the larger diameter portion 486B by the rotation of driving cam 485. This causes the pivot of first link member 431 in the counter clockwise direction in FIG. 29 (clockwise direction in FIG. 19). Accompanied with the first link member 431, the second link member 432 pivots in the same direction, finally, the slider 550 returns to the home position.

When the slider 550 returns to the home position, the clip 501 is prevented from returning back together with the slider 550, because of non-return claw 541 on non-return claw plate 540 attached to the guide plate portion 530 of device body 411.

On the other hand, the cam 490 pivots together with the driving cam 485. Here, the smaller diameter portion R1 of cam 490 corresponds to the portion 486C of cam channel 486 in the driving cam 485 (See FIG. 27). Hence, when the slider 550 reciprocates, the smaller diameter portion R1 of cam 490 is brought into contact with the shaft 462, while the clamp members 451 and 452 are kept in the same situation shown in FIG. 29.

Next, the driving cam 485 further rotates so that the fore end portion 431*b* of arm portion 431A moves in the larger diameter portion 486B of cam channel 486. Then, the shaft 462 is brought into contact with the circumferential surface of increasing diameter portion R2 of cam 490. Thus, the clamp pivot member 453 pivots around the shaft 463 serving as the supporting point in the counter clockwise direction (in FIG. 29). According to this pivot, the clamp members 451, 452 pivot so that they become to close. At the same time, this pivot makes the clip 501' to proceed forward and bend so as to be V-shape.

Further, the rotation of driving cam 485 allows the shaft 462 of clamp pivot member 453 to reach at the circumferential surface of larger diameter portion R3. This allows the clamp portions 473, 477 to be closed further, hence the clip 501' is folded so that the bending portion 501*a* is locked inwardly with the clamp members 451, 452. Finally, the bundle of sheets S is bound with the clip 501'.

The rotation of driving cam 485 allows the shaft 462 of clamp pivot member 453 to slide on and contact with the circumferential surface of decreasing diameter portion R4 of driving cam 490. In this situation, the clamp pivot members 453 pivot in the clockwise direction around the shaft 463 as the supporting point, whereby, the clamp members 451, 452 are pivoted so as to be opened, contrary to the direction stated above. Then, when the shaft 462 of clamp pivot member 453 reaches at the circumferential surface of smaller diameter portion R1, that is to say, after one rotation of driving cam 485 and cam 490, the clamp members 451, 452 return to the home positions shown in FIG. 29. The micro switch M2 detects the concave portion 490A of cam 490, which causes the stop of driving motor 481.

As stated in the foregoing, in accordance with the present invention, with regardless to the size of gap between the clip 501 and clip 501', the clip 501 can be carried surely to the correct position for binding the sheets. Additionally, even if the reciprocation of slider is stopped in the middle of reciprocative operation of link driving means, the link driving means is prevented from being locked.

Third Embodiment

A clipping device according to a third embodiment is provided to solve the following problem.

In the case where a clip-arranged belt is formed by connecting plate-shaped clips in the direction of width, when the belt is wound so as to be a role, a gap should be provided between each pair of adjacent clips in order to decrease the curvature. However, such gap causes the following situation. Precisely, in the electrical staple, since the staple sensor cannot receive the light reflected at the gap between the clips, the sensor determines as if the clip does not exist. Finally, the clipping device is not activated.

The clipping device in accordance with the third embodiment has the object to decrease error in detecting whether the clip exists or not in the clipping device, in which the plate-shaped clips are connected so as to be a belt before winding for increasing the amount of clip stack. Now, the clipping device in accordance with the third embodiment will be explained referring to the drawings.

Figure 38:
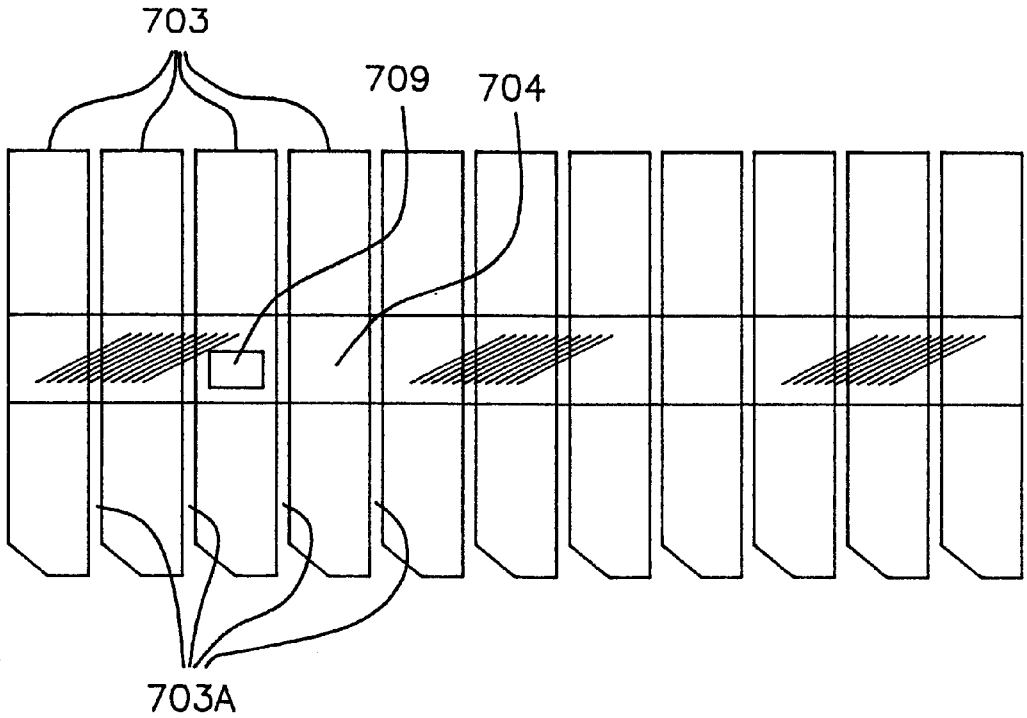
FIG. 38 shows a detecting means provided in a clipping device according to a third embodiment of the present invention.
Figure 39:
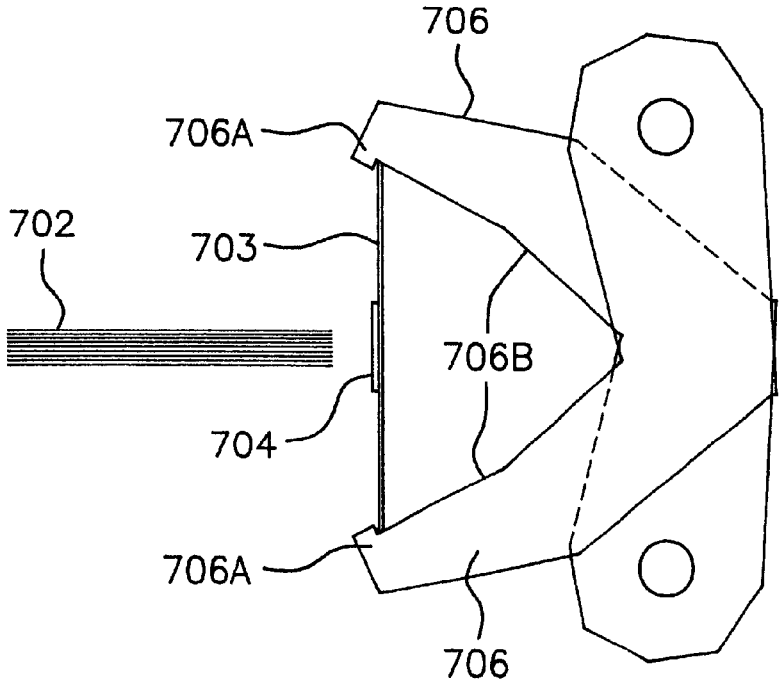
FIG. 39 shows the construction of clamps of the clipping device according to the third embodiment.
Figure 41:
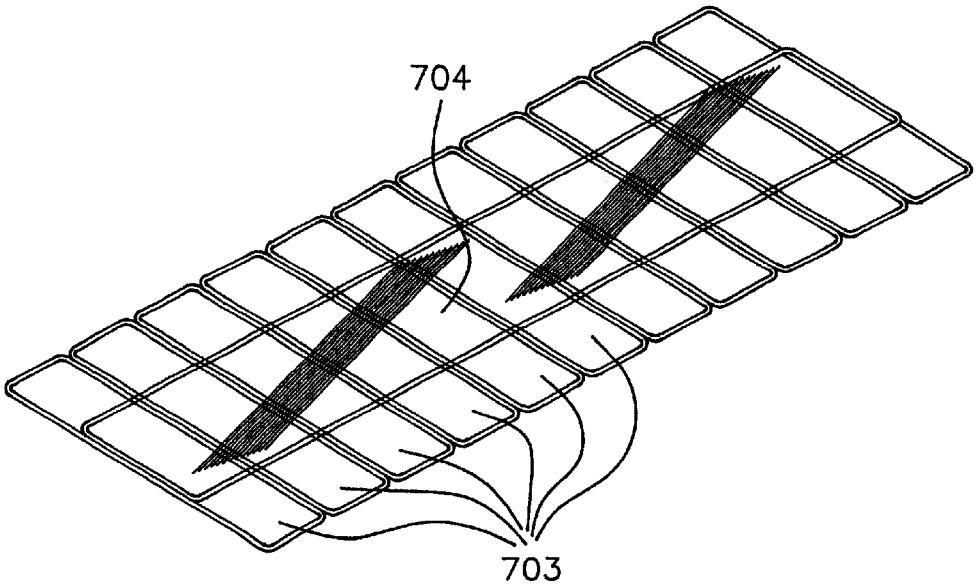
FIG. 41 is a perspective view of a part of a clip-arranged belt for use in the clipping device according to the third embodiment.
Figure 42:
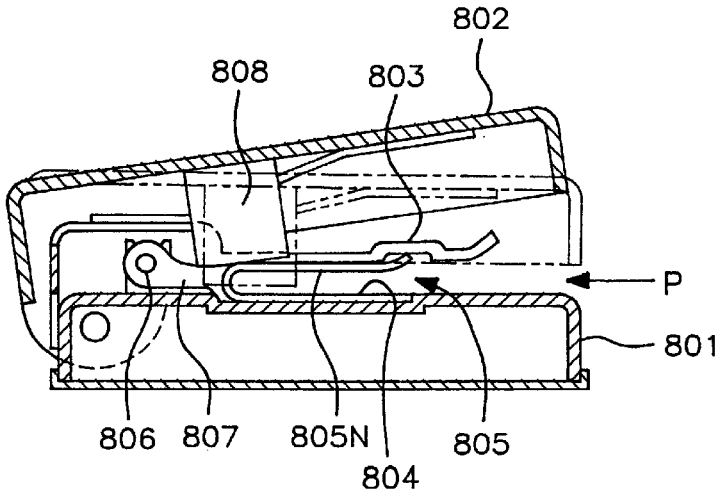
FIG. 42 (PRIOR ART)
FIG. 42 is a schematic view of a conventional clipping device.
Figure 43:
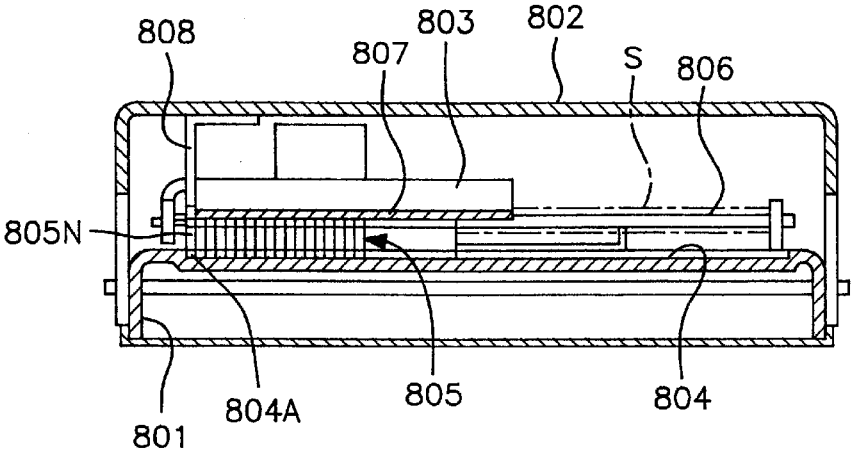
FIG. 43 (PRIOR ART)
FIG. 43 is a schematic sectional view of the conventional clipping device, seen from the side of an inlet through which sheets are inserted.
Figure 44:
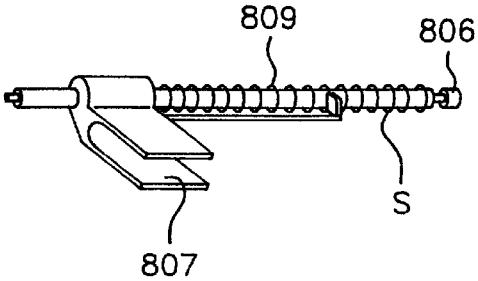
FIG. 44 (PRIOR ART)
FIG. 44 is a perspective view of a push bar of the conventional clipping device.

FIG. 39 shows the construction of portion, by which nipping operation is performed in the clipping device in this embodiment of the present invention. A clip-arranged belt 701 is set between the clamps 706, 706 and used for nipping sheet materials 702. As shown in FIGS. 38 and 41, clips 703, each of which has rectangle and elongated shape, as shown in FIG. 38 particularly, and each of which is to be separated from the clip-arranged belt 701, are connected with a plastic film 704 serving as a connecting member of belt member. One of four corners of clip 703 is cut away at an angle. For example, when a clip 703, which has been used for nipping sheet materials, is removed and used for nipping again, such cut portion is used conveniently for easy re-nipping sheet materials. The clip 703 is plate-shaped and fabricated with a metal plate such as iron piece to which, for example, zinc galvanization is applied, stainless steel or the like. Further, color coating may be applied to the clip. Since the clip 703 is formed with press working, burrs are formed by diening out press. Accordingly, the surface, on which the burrs are formed, is used as the facing (directing) surface to the end portion of sheet materials 702.

The plastic film 704 is belt-shaped and adhered to the adjacent center of each clip 703. The plastic film 704 and each clip 703 are adhered so as not to separate each other. When the clip 703 is bent, the plastic film 704 is cut in the direction of width along the longitudinal direction of clips 703. Thus, the clip 703 is separated from the clip-arranged belt 701. Used for the plastic film 704, there may be materials easily available in the market such as polyethylene, polyester, and the like, which tend to be drawn in the direction of width of belt. Particularly, by using low density polyethylene, polyvinyldene chloride, and the like, which are soft and thick, are more suitable, because of their high ability for holding papers of sheet materials 702.

A large number of clips 703 are arranged with the gaps 703A of the same length in the direction of width, thus, it is easy to wind them so as to be a role. The above plastic film 704 is adhered to the arranged clips 703, 703, . . . , on their faces, on each of which burrs are formed due to pressing. Thus, the clip-arranged belt is formed. Further, the clip-arranged belt 701 is wound in such direction that the plastic film 704 is exposed outwardly.

Figure 40:
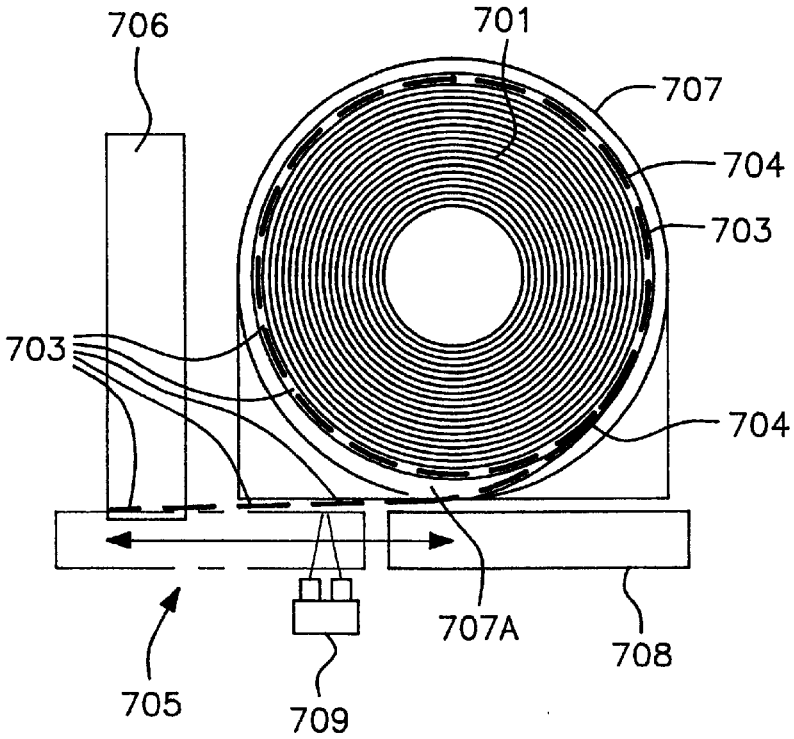
FIG. 40 shows the detecting means disposed in the vicinity of the clamps according to the third embodiment.

This clip-arranged belt 701, which is wound so as to be the role, is loaded in a cartridge 7 of clipping device 705 shown in FIG. 40. The clipping device 705 is placed adjacent to the outlet or tray, where many papers are piled of a device such as copying machine, facsimile terminal equipment, printer or the like. Alternatively, it is needless to say that the clipping device 705 may not be attached but used independently. The clipping device 705 comprises a pair of clamp 706, 706; a driving mechanism, which opens and closes the clamps 706, 706; a slider 708, which feeds the clip 703 from the clip-arranged belt 701 so as to be placed between the clamps 706, 706; a driving mechanism of slider 708; and detecting means 709, which detects the clip-arranged belt 701.

The detecting means 709 is provided so as to be directed toward an area where the plastic film 704 of clip-arranged belt 701 is fed. The plastic film 704 comprises a film covering the metallic portion of clip 703. As shown in FIG. 40, in the case where the light, which has been emitted from an light emitting diode of detecting means 709, is reflected and received for detecting with a phototransistor, detection can be performed correctly because of high reflectivity of such plastic film. As the detecting means 709, there are reflex interrupter, photo sensor, photoswitch and the like, which are formed by utilizing light emitting diode and CD cell, phototransistor, or photodiode. In a clipping device itself, or in a copying machine, facsimile terminal equipment or the like having clipping device, there is equipped an indicator for indicating whether the clip exists or not. Then, when the detecting means 709 detects the reflected light, the light of such indicator is not turned on. On the other hand, when the detecting means 709 does not detect the reflected light, the light of such indicator is turned on for indicating that the clip does not exist. In order to control on-off of indicator's light, on-off control is performed with a electrical circuit connected to the output terminal of detecting means 709. Alternatively, may be used program control performed by input of detecting signal of detecting means 709 to a microprocessor included in a copying machine or the like.

Each clip 703 is engaged by a claw (not shown) of slider 708 and pulled out from the cartridge 707 through an outlet 707A for being engaged between the base portions of jaws 706A, 706A (FIG. 39), which are formed at the fore end portions of clamps 706, 706 respectively (See FIG. 40). The clip 703 is provided such that its burr-surface, to which the plastic film 704 is adhered; is directed toward the sheet materials 702. The jaws 706A, 706A are projected from the internal surfaces 706B, 706B faced each other, with the height, which is determined so as to be substantially the same as or somewhat larger than the thickness of clip 703. Thus, the sheet materials 702 can be nipped so as to be fastened with clips 703 without any disturbance caused by the height of jaws 706A, 706A.

For using the clip of clipping device in this embodiment, since the plastic film 704, which is the connecting material for clip 703, is directed to the sheet material-side, when the clip 703 is bent for binding the sheet materials 702, the plastic film 704 is not exposed outside of clip 703. Therefore, the outside of clip 703 binding the sheet materials 702 has a smooth surface. The clip 703 of clip-arranged belt 701 is separated from the clip-arranged belt 701 when the sheet materials are nipped.

What is claimed is:

1. A clipping device comprising:

a cartridge containing a belt of plate-shaped clips arranged like a belt, said cartridge being provided with an outlet for the clips;

a pair of clamps for holding and bending both ends of a clip occupying a front position of the belt of plate-shaped clips and thereby separating the front clip from the belt of plate-shaped clips and fastening a bundle of sheets with the separated front clip;

a slider that reciprocates between said cartridge and said pair of clamps and feeds the belt of plate-shaped clips from said cartridge to said pair of clamps;

control means for controlling and driving said pair of clamps and said slider; and clip-setting-detecting means for detecting whether one of the plate-shaped clips is held by said pair of clamps or not;

wherein said control means has a detecting step in which said slider is caused to perform an operation of feeding the belt of plate-shaped clips per a clip a predetermined number of times in a state in which said pair of clamps are opened and are ready to receive the belt of plate-shaped clips when no clip is set between said pair of clamps and, if the belt of plate-shaped clips is not detected by said clip-setting-detecting means during the predetermined number of times, said pair of clamps and said slider are stopped from being driven.

2. The clipping device according to claim 1, further comprising display means for indicating that the belt of plate-shaped clips is not set between said pair of clamps in the detecting step.

3. The clipping device according to claim 1, further comprising:

clip-in-cartridge detecting means, disposed in the vicinity of said outlet of said cartridge, for detecting that said cartridge does not contain the belt of plate-shaped clips, said clip-in-cartridge detecting means comprising a photosensor equipped with a light emitting device and a light receiving device for receiving reflected light emitted from the light emitting device and reflected by said cartridge; and no-rest display means for indicating that said cartridge does not contain the belt of plate-shaped clips, based on an output from said clip-in-cartridge detecting means.

4. The clipping device according to claim 1, wherein said control means has link means for reciprocating said slider and link-driving means for driving said link means, said link means having absorption means for absorbing reciprocating movement of said link driving means and thereby stopping a reciprocating movement of said slider when said link driving means operates to reciprocate said slider in spite of the fact that said slider has reached a predetermined position between said pair of clamps and is stopped there by said stopper.

5. The clipping device according to claim 4, wherein:

said link means comprises:

a reciprocation link member by which said slider is reciprocated; and a drive link member disposed between said link driving means and said reciprocation link member, said drive link member being capable of transmitting a driving force of said link driving means to said reciprocation link member; and said absorbing means comprises:

a spring connecting said reciprocation link member and said drive link member to each other, said spring being compressed by pressure of said drive link member when said link driving means continues to drive in spite of the fact that the belt of plate-shaped clips has been fed by said reciprocation link member to said pair of clamps in an open state and is stopped there by a stopper.

6. The clipping device according to claim 1, wherein the belt of plate-shaped clip is composed of a plurality of plate-shaped clips arranged on a belt-shaped connecting member with a predetermined gap between each of them, and connecting-member detecting means is provided for detecting said connecting member, said connecting-member detecting means being disposed in the vicinity of said pair of clamps and in an area through which said connecting member passes.

7. The clipping device according to claim 1, wherein said control means has link means for reciprocating said slider and link-driving means for driving said link means, said link means having absorption means for absorbing reciprocative driving of said link driving means and thereby stopping a reciprocating movement of said slider when said link driving means operates to reciprocate said slider in spite of the fact that said slider has reached a predetermined position between said pair of clamps and is stopping there; and wherein the belt of plate-shaped clips is formed by allowing a plurality of plate-shaped clips to adhere to each other with a belt-shaped connecting member, and connecting-member detecting means is provided for detecting said connecting member, said connecting-member detecting means being disposed in the vicinity of said pair of clamps and in an area through which said connecting member passes.

* * * * *